US007352132B2

(12) United States Patent
Ishigami et al.

(10) Patent No.: US 7,352,132 B2
(45) Date of Patent: Apr. 1, 2008

(54) METAL HALIDE LAMP AND METAL HALIDE LAMP LIGHTING DEVICE WITH IMPROVED EMISSION POWER MAINTENANCE RATIO

(75) Inventors: Toshihiko Ishigami, Kawasaki (JP); Mikio Matsuda, Tokyo (JP); Toshio Hiruta, Hiratsuka (JP)

(73) Assignee: Harison Toshiba Lighting Corp., Imabari-shi (JP)

( * ) Notice: Subject to any disclaimer, the term of this patent is extended or adjusted under 35 U.S.C. 154(b) by 305 days.

(21) Appl. No.: 10/999,768

(22) Filed: Nov. 30, 2004

(65) Prior Publication Data

US 2005/0134182 A1 Jun. 23, 2005

(30) Foreign Application Priority Data

Dec. 22, 2003 (JP) ..... 2003-424941

(51) Int. Cl.
*H01J 61/12* (2006.01)
*H01J 61/18* (2006.01)
*H01J 17/20* (2006.01)

(52) U.S. Cl. ..... 313/637; 313/638; 313/640

(58) Field of Classification Search ..... None
See application file for complete search history.

(56) References Cited

U.S. PATENT DOCUMENTS 3,259,777 A 7/1966 Fridrich
4,445,067 A * 4/1984 Inoue et al. ..... 313/54
4,686,419 A 8/1987 Block et al.
4,801,846 A * 1/1989 Kramer et al. ..... 313/641
6,211,616 B1 * 4/2001 Takeuti et al. ..... 313/637
6,316,875 B1 11/2001 Kirkpatrick et al.
6,353,289 B1 * 3/2002 Ishigami et al. ..... 313/637
6,469,446 B1 10/2002 Stockwald
6,492,772 B1 * 12/2002 Takeuchi ..... 313/633
6,495,962 B2 * 12/2002 Uemura et al. ..... 315/77
6,528,946 B2 * 3/2003 Ishigami et al. ..... 313/637
6,873,109 B2 * 3/2005 Ishigami et al. ..... 313/640
2001/0056294 A1 12/2001 Hiramoto et al.
2002/0017860 A1 2/2002 Nishida et al.
2002/0125823 A1 9/2002 O'hare et al.
2003/0201719 A1 10/2003 Ikeuchi et al.

(Continued)

FOREIGN PATENT DOCUMENTS

EP 0479634 10/1990

(Continued)

OTHER PUBLICATIONS

Takada, Fuko, "Lighting Technology for Motor Vehicle (2)", (2002); vol. 86(12); p. 897.

(Continued)

*Primary Examiner*—Mariceli Santiago
(74) *Attorney, Agent, or Firm*—John P. White; Cooper & Dunham LLP

(57) ABSTRACT

A metal halide lamp includes a refractory, light-transmitting hermetic vessel, a pair of electrodes sealed in thehermetic vessel, a discharge medium including a halide and a rare gas, and metal storing means storing at least one selected from the group consisting of potassium (K), rubidium (Rb) and cesium (Cs), the metal storing means being heated during lighting and gradually discharging at least one metal in the hermetic vessel.

25 Claims, 10 Drawing Sheets

U.S. PATENT DOCUMENTS

2005/0099129 A1* 5/2005 Ishigami et al. ..... 313/637

FOREIGN PATENT DOCUMENTS

| | | | |
|---|---|---|---|
| EP | 1156512 | A1 | 11/2001 |
| GB | 1190833 | | 5/1970 |
| JP | 59-167948 | | 9/1984 |
| JP | 60167251 | | 8/1985 |
| JP | 63281343 | | 11/1988 |
| JP | 63281344 | | 11/1988 |
| JP | 20011060403 | | 3/2001 |
| JP | 2003257367 | | 9/2003 |
| JP | 2003377813 | | 11/2003 |

OTHER PUBLICATIONS

Aug. 17, 2006 EPO Communication and European Search Report.

* cited by examiner

METAL HALIDE LAMP AND METAL HALIDE LAMP LIGHTING DEVICE WITH IMPROVED EMISSION POWER MAINTENANCE RATIO

CROSS-REFERENCE TO RELATED APPLICATIONS

This application is based upon and claims the benefit of priority from prior Japanese Patent Application No. 2003-424941, filed Dec. 22, 2003, the entire contents of which are incorporated herein by reference.

BACKGROUND OF THE INVENTION

1. Field of the Invention

The present invention relates to a metal halide lamp suitable as a light source for a vehicle headlight and/or infrared night imaging vision apparatus, and a metal halide lamp lighting apparatus using the metal halide lamp.

2. Description of the Related Art

Various researches have been made concerning the safety of vehicles. See, for example, "Illuminating Engineering Institute Journal", Vol. 86, No. 12, pp. 896-899, published 2002. This document discloses an infrared night imaging vision apparatus for vehicles as vehicle safety means. Infrared night imaging vision apparatuses for vehicles are called "Night Vision" (trademark), and developed as nighttime safety drive support systems for drivers utilizing the properties of infrared rays, to enhance the visibility of pedestrians, obstacles or traffic signs ahead of a vehicle. In 1999 in the US, an infrared night imaging vision apparatus was introduced to the market for the first time. An obstacle, for example, that is a long way away and cannot be detected using headlights is photographed using an infrared camera, and its image is displayed for a driver. Infrared light has longer wavelengths than visible light. Therefore, when detecting an obstacle, for example, at night in the rain or mist, it is more advantageous for a driver to acquire an image of the obstacle using infrared light, than to directly see it using visible light. Further, the driver can detect an obstacle from its image acquired using infrared light, even if, for example, they are dazzled by light emitted from the headlights of an oncoming vehicle.

Infrared night imaging vision apparatuses for vehicles include passive ones and active ones. Passive apparatuses detect, using a far-infrared camera, far-infrared light (with wavelengths of 8-14 μm) emitted from an obstacle. Apparatuses of this type are disadvantageous in that the camera is expensive and its accuracy of detection is degraded when it rains or snows. In contrast, active apparatuses emit near-infrared light to an obstacle using a projector, and detect reflected light using a CCD camera that senses near-infrared light. Further, a conventional light source for infrared night vision projectors is formed of a combination of a halogen bulb and wavelength correcting filter, and projects near-infrared light of 780 nm to 1.2 μm. Apparatuses of this type are advantageous in that the camera is not expensive and provides images near visible light ones. In apparatuses of both types, the detected images are displayed on a head-up or head-down display.

In active apparatuses, a lamp unit is known which is provided with a discharge tube containing a halide of cesium, and a near-infrared transmission filter on the tube, the discharge tube and filter being used as a light source for the infrared night imaging vision apparatus. See, for example, Jpn. Pat. Appln. KOKAI Publication No. 2003-257367. The lamp unit disclosed in this document emits near-infrared light by discharge, using either cesium iodide or cesium bromide. This near-infrared light is extracted by the near-infrared transmitting filter surrounding the lamp. Thus, the near-infrared light is intended to be dedicated to the infrared night imaging vision apparatus. Further, the document also discloses a technique for enabling the near-infrared transmitting filter to be retracted from around the discharge tube, thereby making the lamp also usable as a vehicle fog lamp. That is, the document describes that the lamp unit can also be used as a fog lamp when it is used as a light source dedicated to the night imaging vision apparatus. This lamp unit, however, cannot be used as a vehicle headlight.

As described above, vehicle infrared night imaging vision apparatuses of the active type are advantageous compared to passive ones. However, apparatuses of the active type need to use a dedicated light source at least when they are used as night imaging vision apparatuses. This being so, it is necessary to prepare a light source dedicated to the infrared night imaging vision apparatus, in addition to a vehicle headlight, or to prepare a complex fog lamp with a movable section. As a result, they become expensive.

In contrast, the inventor of the present invention has previously developed, as an embodiment of an invention, a metal vapor discharge lamp including a light source for both a vehicle headlight and infrared night imaging vision apparatus. This invention was filed as Jpn. Pat. Appln. No. 2002-294617 (hereinafter referred to as "the prior invention 1" for facilitating the explanation). Further, the inventor has proposed a 35-watt mercury-free metal halide lamp for both a vehicle headlight and infrared night imaging vision apparatus in Jpn. Pat. Appln. No. 2003-377813 (hereinafter referred to as "the prior invention 2" for facilitating the explanation).

In the lamp unit and lamps described in the above-mentioned patent document and prior inventions 1 and 2, alkali metals such as sodium (Na), potassium (K), rubidium (Rb) and cesium (Cs) are mainly used for the emission of near-infrared light. These alkali metals, which are sealed as metal halides, emit lines of the following wavelengths at the near-infrared region:

Na: 818.3 nm, 819.4 nm, 1138.1 nm, 1140.1 nm

K: 766.4 nm, 769.8 nm, 1168.9 nm, 1177.1 nm

Rb: 761.9 nm, 775.7 nm, 775.9 nm, 780.0 nm, 794.7 nm, 887.3 nm

Cs: 760.9 nm, 801.5 nm, 807.9 nm, 852.1 nm, 876.1 nm, 894.3 nm, 917.2 nm, 920.8 nm, 1002.0 nm, 1012.0 nm.

Although in the patent document and prior inventions 1 and 2, the above alkali metals are sealed as metal halides, they exist in the form of neutral metals or ions during lighting of the lamps. Alkali metals have only one electron in the outermost orbit, therefore can be very easily ionized. Accordingly, they are liable to move through the material of a hermetic vessel when a voltage is applied. This tendency is especially strong in Li or Na which have a small atomic radius. The phenomenon of movement of Li or Na atoms in the material of the hermetic vessel is known as a Li or Na dropout. The same tendency is also seen in K, Rb and Cs. Because of this, a reduction in the quantity of such a metal in the hermetic vessel is observed during long-term lighting.

This phenomenon raises a problem in which the energy of emission of near-infrared light is reduced during long-term lighting of a metal halide lamp. Therefore, when the near-infrared light of a metal halide lamp is mainly utilized, the life span of the lamp as a near-infrared source is shortened. However, a more serious problem is raised if the visible light and near-infrared light of a metal halide lamp are simultaneously utilized. In this case, the emission power maintenance ratio of near-infrared light is significantly reduced compared to that of visible light. As a result, the monitoring range of the infrared night imaging vision apparatus is decreased because of the reduction of the near-infrared emission power maintenance ratio, although the lamp has a long life as a light source for a headlight. This shortens the actual life of the lamp.

The above problems become more serious if as in prior invention 2, the initial luminous flux must be kept within a predetermined range. If the energy of near-infrared light that occupies the entire quantity of emission is increased, that of visible light is relatively reduced. Accordingly, to keep the total luminous flux within a predetermined range, the emission power of near-infrared light cannot be set high.

It is known that a so-called HID headlight that uses a metal halide lamp as a visible light source is a very bright lamp. Therefore, a good deal of reduction in total luminous flux is permitted. According to Japan Electric Lamp Manufacturers Association Regulation JEL215 1998, it is sufficient if 60% or more of the original total luminous flux is maintained after the lamp has been lit for 1500 hours. In contrast, in the case of a metal halide lamp for infrared night imaging vision apparatuses, the emission power of near-infrared light is kept low at and after the initial stage of lighting as described above. Therefore, if a significant reduction in near-infrared light output occurs during long-term lighting, the visibility performance of the infrared night imaging vision apparatus itself may well disappear.

BRIEF SUMMARY OF THE INVENTION

It is an object of the invention to provide a metal halide lamp having its near-infrared emission power maintenance ratio improved through the life span of the lamp, and to provide a metal halide lamp lighting device using this metal halide lamp.

It is another object of the invention to provide a metal halide lamp that satisfies the standards set, in particular, for mercury-free HID lamps for headlights, and that can provide near-infrared emission power sufficient for an infrared night imaging vision apparatus over a long period, and to provide a metal halide lamp lighting device using this metal halide lamp.

In accordance with a first aspect of the invention, there is provided a metal halide lamp comprising: a refractory, light-transmitting hermetic vessel; a pair of electrodes sealed in the hermetic vessel; a discharge medium including a metal halide and a rare gas; and metal storing means storing at least one selected from the group consisting of potassium (K), rubidium (Rb) and cesium (Cs), the metal storing means being heated during lighting and gradually discharging the at least one metal in the hermetic vessel. The emission power ratio of visible light with wavelengths of 380 to 780 nm to near-infrared light with wavelengths of 750 to 1100 nm is 0.5:1 to 4.0:1 during stable lighting.

In the above-described invention and each invention described below, the terms used have the following definitions and technical meanings if they are not particularly designated:

Re: Hermetic vessel:

The hermetic vessel is refractory and light-transmittable. Further, the internal volume of the hermetic vessel can be set in accordance with the purpose. For headlights, the internal volume is generally set to 0.005 to 0.1 cc, preferably, 0.01 to 0.05 cc. In this case, the maximum diameter portion of the hermetic vessel has an inner diameter of 2 to 10 mm and an outer diameter of 5 to 13 mm. The expression "refractory and light-transmittable" means that the vessel is strong enough to resist the standard operation temperature of discharge lamps, and can transmit, to the outside, visible light and infrared light of respective desired wavelength ranges generated by discharge. Accordingly, the hermetic vessel may be formed of any material if the material is refractory and light transmittable. For example, it may be polycrystal or monocrystal ceramics, such as quartz glass, light-transmitting alumina, YAG. When necessary, it is allowed to form, on the inner surface of the hermetic vessel of quartz glass, a light-transmitting film having a resistance against halogens or halides, or to improve the quality of the inner surface of the hermetic vessel.

The hermetic vessel is generally provided with an envelope section and a pair of cylindrical sealing sections. The envelope section defines therein a discharge space, preferably, a slim discharge space, which provides the above-mentioned internal volume. The slim discharge space may be a cylindrical one. In this case, in horizontal lighting, if discharge arc is curved upwards, it approaches the inner surface of the upper portion of the discharge vessel, therefore the temperature of the upper portion quickly increases. Further, the envelope section can be made relatively thick. That is, the substantially central portion of the envelope section between the electrodes can be made thicker than the opposite ends. As a result, the heat transmission of the discharge vessel is enhanced, whereby the temperature of a discharge medium stuck to the inner surfaces of the lower and side portions of the discharge space is quickened, which quickens the rise of a luminous flux.

The pair of sealing sections seal the envelope section, support the axial portions of the electrodes, and serve as means for airtightly guiding a current from the lighting circuit to the electrodes. The sealing sections are formed integrally with the opposite ends of the envelope section. To seal the electrodes and to airtightly guide a current from the lighting circuit to the electrodes, the sealing sections airtightly bury therein metal foils as airtightly sealed conductive means, when the hermetic vessel is formed of, preferably, quartz glass. The sealed metal foils are buried in the sealing sections that keep airtight the interior of the envelope section of the hermetic vessel. The metal foils cooperate with the sealing sections to function as current guiding members. When the hermetic vessel is formed of quartz glass, molybdenum (Mo) is the most appropriate material for the metal foils. Since molybdenum is oxidized at about 350° C., proximal ends of the metal foils are buried such that they are lower than 350° C. The sealed metal foils can be buried in the sealing sections using various methods. For example, pressure sealing, pinch sealing, or combination thereof may be employed. The latter method is appropriate for a metal halide lamp for, for instance, vehicle headlights, which has an internal volume of 0.1 cc or less and contains a gas, such as xenon (Xe), of six atoms or more at room temperature.

Re: Electrodes:

The pair of electrodes are sealed in the hermetic vessel, opposing each other at a predetermined distance with a discharge space interposed therebetween. As a metal halide lamp for vehicle headlights, it is preferable to set the inter-electrode distance to 5 mm or less, and more preferable to set to 4.2±0.3 mm. Preferably, the electrodes have a linear axial portion having substantially the same diameter in the longitudinal direction. The diameter of the axial portion is, preferably, 0.25 mm or more, and more preferably, 0.45 mm or less. The diameter of the axial portion is substantially constant. The distal end of each electrode is formed flat, or has a curved surface serving as the starting point of an arc. Alternatively, the distal end may be formed to a larger diameter than the axial portion.

In addition, the electrodes can be formed of a refractory and conductive metal, such as pure tungsten (W), doped tungsten, thoriated tungsten containing a thorium oxide, rhenium (Re) or a tungsten-rhenium alloy (W—Re), etc. It is preferable, however, a doped material is preferable if the electrodes also serve as metal storing means, described later.

Re: Discharge Medium:

The discharge medium is sealed in the hermetic vessel and serves to cause discharge in a vaporized or gas state. The discharge medium contains a halide and a rare gas.

(Halide) The halide may contain at least one of first to third halides.

The first halide is sealed to increase, to a desired value, the vapor pressure of a metal that mainly emits visible light. Accordingly, the first halide is indispensable to mainly generate visible light. However, in the case of mainly emitting near-infrared light, the first halide can be selectively sealed. Further, for the first halide, a single metal or a plurality of metals may be selected from metals that emit various visible light beams, depending upon the purpose of the metal halide lamp.

The second halide is sealed to control the vapor pressure of a metal that mainly emits near-infrared light. Accordingly, to mainly emit near-infrared light, it is desirable to seal the second halide. However, in the present invention, it is sufficient if near-infrared light with wavelengths of 750 to 1100 nm is emitted, and the emission of near-infrared light by the second halide is dispensable. Further, the metal storing means, described later, also discharges a metal that emits near-infrared light. This metal is bonded with a free halogen to thereby form a halide, thereby emitting near-infrared light during electrical discharge in the lamp.

Furthermore, the second halide serves to suppress reaction of a metal for emitting near-infrared light with the structural elements of the hermetic vessel.

As the second halide, a halide of a metal that mainly emits light with wavelengths of 750 to 1100 nm is preferable. Infrared night imaging vision apparatuses for vehicles sense, with high sensitivity, near-infrared light with wavelengths of 750 to 1100 nm. The expression "to mainly emit near-infrared light" means that the light of highest emission power emitted is near-infrared light, and/or that the light having effective emission energy that can be reliably sensed by the infrared night imaging vision apparatus is near-infrared light, regardless of whether the emission spectrum is a bright-line spectrum or continuous spectrum. Therefore, it is sufficient if the lamp light satisfies at least one of the above meanings. This is because if the lamp light satisfies at least one of the above meanings, it is effective near-infrared light for the infrared night imaging vision apparatus. On the other hand, if the light of highest emission power exists in the near-infrared region, the emission power of infrared light necessary to make the infrared night imaging vision apparatus sensible is minimized. Therefore, the emission power to be distributed to visible light is increased, which is much more preferable for a metal halide lamp that is used as a light source for both visible light and infrared light.

In general, "near-infrared range" indicates a wavelength range of 780 nm to 2 μm. In the present invention, it is preferable to seal the second halide and thereby mainly emit near-infrared light of 750 to 1100 nm, as described above. At this time, a single or a plurality of metals may be used. Most preferably, at least one metal is selected from potassium (K), rubidium (Rb) and cesium (Cs).

The third halide is sealed to enhance the vapor pressure of a metal that serves as a buffer metal vapor instead of mercury. Accordingly, the third halide is indispensable for a mercury-free lamp that contains substantially no mercury, and is dispensable for a lamp using mercury.

Halogens included in halides will be described. Concerning reactivity, iodine is most appropriate, and iodides are sealed at least as the main-light emission metals. If an appropriate amount of bromine is sealed as bromides, they effectively suppress blackening of the inner surface of the hermetic vessel. When necessary, different halides including, for example, iodides and bromides, may be contained.

(Rare Gas) The rare gas serves as a starting gas and buffer gas, and may comprise at least one selected from argon (Ar), krypton (Kr), xenon (Xe), etc. Among the rare gases, xenon mainly emits near-infrared light of 820 to 1000 nm. Therefore, xenon is effective to increase the emission power of near-infrared light. The emission power of near-infrared light of 820 to 1000 nm is effectively sensed by infrared night imaging vision apparatuses for vehicles.

Further, xenon (Xe) not only serves as a starting gas and buffer gas for the metal halide lamp of the invention, but also emits visible light of white upon ignition of the lamp where the vapor pressure of halides is low. If xenon of appropriate pressure is sealed, it contributes to the rise of a luminous flux, and to an increase in the emission power of near-infrared light. The appropriate pressure of xenon is 6 atoms or more, more preferably, 8 to 16 atoms. If xenon of appropriate pressure is sealed, the emission power of near-infrared light is increased, and the white light emitted from xenon is utilized as a luminous flux upon the ignition of the lamp where the vapor pressure of a light emission metal is low. Thus, the standard concerning white light stipulated for a HID lamp for use in vehicle headlights is satisfied even upon the ignition of the lamp.

(Mercury) The metal halide lamp of the invention may be of a mercury-contained type or a mercury-free type.

R: Metal Storing Means:

The metal storing means stores at least one selected from the group consisting of potassium (K), rubidium (Rb) and cesium (Cs). The metal storing means is heated during lighting, with the result that it gradually discharges the stored metal through the life span of the lamp. The metal storing means can simultaneously store two or more of the metals included in the group. As can be understood from the feature of the present invention, the structure for storing a metal is not limited. The above metals are alkali metals and have respective low melting points (K: 63.65° C.; Rb: 38.89° C.; Cs: 28.40° C.) and low boiling points (K: 774° C.; Rb: 688° C.; Cs: 678.4° C.). Therefore, the metal storing means that relatively easily emits a metal when it is heated during lighting can be constructed specifically. For example, the metal storing means can be formed of a refractory metal, such as tungsten or molybdenum, doped with the above metal(s). Doping is performed in a standard manner before powder of the refractory metal is sintered. After the resultant power is sintered, a doped refractory metal is acquired.

Further, the metal storing means is heated by any appropriate method during lighting of the metal halide lamp. For instance, the metal storing means may be constructed such that its temperature is increased in accordance with an increase in the temperature of the metal halide lamp itself during lighting. Alternatively, the metal storing means may be heated by the heat radiated during lighting of the lamp. Yet alternatively, the metal storing means may be heated by the Joule heat generated when a lamp current flows through the electrodes during lighting, and also by the heat generated mainly by the inflow of electrons during the anode phase and transmitted through the electrodes. When necessary, the metal storing means may be heated using the heat generated by the flow of a current different from the lamp current.

In addition, the metal storing means may be formed of one of the electrodes. In this case, the electrodes are formed of a refractory metal, such as tungsten, doped with the above-mentioned metal. Alternatively, the metal storing means may be prepared as an element separate from the electrodes, and be attached to the electrodes by, for example, welding, or may be attached to the inner surface of the hermetic vessel. Further, the metal storing means may be formed by coating the electrodes with the above-mentioned metal, be formed of a rod containing the metal and sealed in the hermetic vessel, or be formed of coils of the metal wound around the electrodes.

When the metal storing means is formed of a refractory metal doped with at least one metal selected from potassium (K), rubidium (Rb) and cesium (Cs), 10 to 200 μg of the at least one metal is added to 1 g of the refractory metal (i.e., 10 to 200 ppm of the at least one metal is contained in the refractory metal). Preferably, 30 to 100 μg of at least one metal is added. For example, effective metal storing means can be formed of an electrode material produced by doping tungsten with 40 to 70 μg of potassium (K), i.e., doped tungsten. In this case, small amounts of aluminum (Al), calcium (Ca), iron (Fe), molybdenum (Mo), silicon (Si), etc. are present as well as potassium. This, however, does not raise any problem in the function and advantage of the invention. Furthermore, in the invention, tungsten to be doped with the metal is thoriated tungsten containing a thorium oxide to enhance the electron emission efficiency.

Re: Ratio of Emission Energy of Visible Light to Near-Infrared Light:

In the invention, the emission power ratio of visible light with wavelengths of 380 to 780 nm to near-infrared light with wavelengths of 750 to 1100 nm is 0.5:1 to 4.0:1. The reason why the wavelength range of the near-infrared light includes part of the visible light range (750 to 780 nm) will now be described with reference to FIG. 1.

FIG. 1 is a graph illustrating the sensitivity characteristic of a CCD camera widely used and also used as an infrared night imaging vision apparatus. As can be understood from the figure, concerning the sensitivity characteristic of the CCD camera used as the infrared night imaging vision apparatus, the camera exhibits the maximum sensitivity for light with a wavelength of about 759 nm, and exhibits lower sensitivity levels for light with wavelengths longer than 759 nm. It is evident from this that near-infrared light with wavelengths of about 780 to 1200 nm can be sensed by a near-infrared type CCD camera. Actually, however, it would be advisable to use visible light with wavelengths of 750 to 780 nm, in addition to this near-infrared light, in order to increase the emission power of light that can be sensed by the CCD camera.

Because of the above, the invention utilizes an emission range of 750 to 1100 nm for the infrared night imaging vision apparatus. On the other hand, it can also be understood from FIG. 1 that visible light with wavelengths of less than 750 nm can be utilized for the infrared night imaging vision apparatus. However, if such visible light is also utilized for the infrared night imaging vision apparatus, the energy of a visible light flux is significantly reduced. Further, for the wavelength range exceeding 1100 nm, the CCD camera exhibits an extremely low sensitivity.

If the emission power ratio is set to 0.5:1 to 4.0:1, it enables various types of use of the metal halide lamp, as will be described later. In the inventions recited in claims 1 to 3 of the present application, assume that the emission power ratio is measured in the initial stage of distribution of metal halide lamps as finished products.

Re: Functions of the Present Invention:

The present invention constructed as above has the following functions:

1. When the metal halide lamp of the present invention is connected to a lighting circuit and lit, it emits visible light with wavelengths of 380 to 780 nm and near-infrared light with a wavelength of 750 to 1100 nm with an emission power ratio of 0.5:1 to 4.0:1.

Since the emission power ratio is set as specified above, the metal halide lamp of the invention is appropriate as a light source dedicated to (1) an infrared night imaging vision apparatus mainly utilizing near-infrared light, to (2) a vehicle headlight mainly utilizing visible light, and to (3) both the infrared night imaging vision apparatus and vehicle headlight. In the case of using the lamp as a light source for both the apparatuses, the lamp may be simultaneously used for them, or used for them at different times. The expression "used for them at different times" means that the lamp is used as a light source for one of them at a time, and used for the other at another time.

2. The present invention incorporates metal storing means that is heated during lighting and hence gradually discharges at least one metal selected from potassium, rubidium and cesium, in the hermetic vessel during the life span of the lamp. The discharged metal is coupled with a free halogen in the hermetic vessel, thereby mainly emitting near-infrared light due to the metal vapor. If the lamp contains potassium, rubidium and/or cesium as a second halide, these metals move through the materials of the lamp and are liable to be lost during the life span of the lamp. However, in the present invention, the metal(s) gradually discharged from the metal storing means compensates for the lost metal(s). In some cases, the amount of the discharged metal(s) is larger than that of the lost metal(s), i.e., the amount of the metal(s) as the second halide metal material is increased.

As a result, the maintenance ratio of the emission power of near-infrared light can be set to a desired value during the life span of the metal halide lamp. The maintenance ratio of the emission power of near-infrared light may be set so that, for example, the emission power is substantially maintained constant, or is increased or reduced with time at an appropriate ratio. These maintenance ratio characteristics can be desirably set by appropriately designing the relationship between the components (and the amounts of the components) of the discharge medium sealed in the manufacturing process, and the metals (and the amounts of the metals) discharged from the metal storing means during the life span of the lamp.

3. A description will now be given of the case where the metal halide lamp of the invention is used as a light source for both a vehicle headlight and infrared night imaging vision apparatus. Visible light can be adjusted to satisfy the standards for vehicle headlights stipulated in, for example, JEL-215-1998 of the Japan Electric Lamp Manufacturers Association, by mainly appropriately selecting the light emitting metal that constitutes a halide (first halide) and the amount of the halide. It should be noted that in the standards, the rated input is 35±3 W, and in the case of D2S type, the total luminous flux is 3200±450 lm, whereas in the case of D2R, the total luminous flux is 2800±450 lm.

Near-infrared light is generated, as described in the above item 1, by a halide (second halide) of at least one metal for mainly emitting near-infrared light, at least one metal discharged from the metal storing means, and a rare gas. Accordingly, if the metal(s) of the halide, the amount of the halide, the metal storing means, and the kind and pressure of the rare gas are appropriately set, a desired luminous quantity of near-infrared light can be produced with a desired luminous quantity of visible light secured.

4. In the case of the active infrared night imaging vision apparatus for vehicles, a CCD camera incorporated in the apparatus includes a CCD image pickup element that has a sensitivity characteristic in which the sensitivity is highest near a wavelength of 759 nm and gradually decreases towards the longer wavelength side. However, this CCD image pickup element senses light with a wavelength of about 1200 nm at maximum.

Accordingly, when the metal halide lamp of the invention, which emits near-infrared light and visible light with wavelengths of 750 to 1100 nm, is used as a light source for both the vehicle headlight and infrared night imaging vision apparatus, the near-infrared light emitted from the lamp is used for the infrared night imaging vision apparatus, and the visible light from the lamp is used for the vehicle headlight, the visible light satisfying the above-described standards. Further, since the metal storing means gradually discharges a metal (metals) for emitting near-infrared light during the life span of the lamp, the power emission maintenance ratio of near-infrared light is kept at a desired value during the life span of the lamp. This prevents the obstacle recognizable range of the infrared night imaging vision apparatus from being significantly reduced.

5. The followings are examples of vehicle headlights, in which the metal halide lamp of the invention used for both of a vehicle headlight and infrared night imaging vision apparatus can be mounted. That is, such vehicle headlights are of a projector 4-light system, a reflector 4-light system, a projector 2-light system and a reflector 2-light system.

The projector 4-light system uses a set of two metal halide lamps of a D3S or D4S type for the low beam and a set of two halogen lamps for the high beam. In this system, of the light radiated from the metal halide lamp, the light beam radiated in the high-beam direction is cut by, for example, a light shield member provided on the headlight. In the metal halide lamp of the present invention, only the near-infrared light of the light radiated in the high-beam direction is selectively guided out with use of, for example, a near-infrared light filter. Thus, the near-infrared light can be used as the light source for the infrared night imaging vision apparatus. The reflector 4-light system uses a set of two metal halide lamps of a D3R or D4R type for the low beam and a set of two halogen lamps for the high beam. As a shielding film for preventing unnecessary glare is formed on an outer tube of a metal halide lamp of a D3R or D4R type to obtain a metal halide lamp of a D3R or D4R type, respectively. The aspect that two halogen lamps are used for the high beam is similar to that of the projector 4-light system. It should be noted that the D3S and D3R types have similar specifications to those of the D4S and D4R types, respectively, except that an igniter is provided at a base section of the lamp.

By contrast, the projector 2-light system has such a structure that the lighting positions of the two metal halide lamps of the D3R or D4R are switched between the low beam mode and high beam mode. In order to switch the switching means here, for example, a light shielding plate is mechanically moved. The reflector 2-light system has such a structure that the lighting positions of the two metal halide lamps of the D4R are switched between the low beam mode and high beam mode. In order to switch the switching means here, for example, the positions of the metal halide lamps are mechanically moved.

Next, the operation principle of the active infrared night imaging vision apparatus, as which the metal halide lamp of the present invention is used, will be described with reference to FIGS. 1 and 2. FIG. 2 is a conceptual figure that illustrates the operation principle of the active infrared night imaging vision apparatus, and FIG. 1 is a graph that illustrates the spectral sensitivity characteristic curve of a CCD camera used for the infrared night imaging vision apparatus. In FIG. 2, reference symbol HD denotes the vehicle headlight, NC denotes the infrared night imaging vision camera and HM denotes an obstacle.

The vehicle headlight HD contains the metal halide lamp of the invention used for both of the vehicle headlight and the infrared night imaging vision apparatus, and visible light VL radiated from the lamp is directed to outside to form an irradiation pattern of the low beam mode. By contrast, near-infrared light IR radiated from the lamp at the same time as the visible light VL is separated from the visible light VL with use of, for example, a visible light shielding member, and directed in the high beam mode direction to irradiate the front of the vehicle.

The infrared night imaging vision camera NC is installed in the vehicle. The camera NC shoots an obstacle HM such as a pedestrian in front of the traveling vehicle, that is irradiated with the near-infrared light projected from the vehicle headlight HD, and displays the shot image on, for example, a head up display (not shown) so that the driver in the vehicle can visually recognize it. The infrared night imaging vision camera NC includes a semiconductor image pickup device that is sensitive to near-infrared light, such as a CCD image pickup element. The CCD image pickup element is used widely as a CCD camera, and has the spectral sensitivity characteristics shown in FIG. 1.

More specifically, in the near-infrared region, the camera NC exhibits the highest sensitivity near a wavelength of 759 nm, and is sufficiently sensitive in a wavelength range of 750 to 1100 nm. The infrared night imaging vision camera NC can employ an optical filter for suppressing the sensitivity for visible light with wavelengths of 750 nm or less.

Therefore, as the radiation power of the near-infrared light radiated from the vehicle becomes higher, the range of shooting for the infrared night imaging vision apparatus becomes longer and the range of visibility becomes longer. On the other hand, when viewed from the obstacle HM side, for example, pedestrian side, if near-infrared light is irradiated from the oncoming vehicle, they are not exposed to glare.

6. When using the metal halide lamp of the invention as a light source dedicated to the infrared night imaging vision apparatus, it is sufficient if the lamp is mounted in a dedicated illumination apparatus, and connected to the lighting circuit.

A second metal halide lamp according to the invention is characterized by comprising: a refractory, light-transmitting hermetic vessel; a pair of electrodes sealed in the hermetic vessel; a discharge medium including a halide and a rare gas; and metal storing means storing at least one selected from the group consisting of potassium (K), rubidium (Rb) and cesium (Cs), the metal storing means being heated during lighting and gradually discharging the at least one metal in the hermetic vessel. The second metal halide lamp is further characterized in that the emission power ratio of visible light with wavelengths of 380 to 780 nm to near-infrared light with wavelengths of 780 to 1200 nm is 2.0:1 to 3.2:1 during stable lighting.

The second metal halide lamp has a structure appropriate as a light source for both a vehicle headlight and an infrared night imaging vision apparatus. That is, if the emission power ratio of visible light and near-infrared light of the above-described wavelength range is 2.0:1 to 3.2:1, the metal halide lamp can emit both visible light that satisfies the standard for vehicle headlights, and near-infrared light required for an infrared night imaging vision apparatus to acquire a predetermined visibility range. Therefore, if the visible light and near-infrared light are separated from each other by optical means, the metal halide lamp of the invention can be used as a light source for both a vehicle headlight and infrared night imaging vision apparatus. If the emission power ratio is less than 2.0:1, only a lower energy of visible light than required for the above-mentioned purpose is acquired. On the other hand, if the emission power ratio is higher than 3.2:1, only a lower energy of near-infrared light than required for the above-mentioned purpose is acquired.

Concerning the structures other than the emission power ratio, the same statements as made regarding the first aspect can be made.

A third metal halide lamp of the invention is similar to the first and second metal halide lamps, except that in the former, the emission power ratio of first near-infrared light with wavelengths of 780 to 800 nm to second near-infrared light with wavelengths of 780 to 1000 nm is 0.1:1 to 0.33:1 during stable lighting.

In the third metal halide lamp, the preferable ratio of the first near-infrared light, particularly effective near-infrared light, to the second near-infrared light with the wavelengths of 780 to 1000 nm that can be sensed by an infrared night imaging vision apparatus is defined. Specifically, an infrared night imaging vision apparatus using a near-infrared type CCD camera exhibits a particularly high sensitivity to the first near-infrared light (with the wavelengths of 780 to 800 nm). Therefore, if the total emission power is predetermined, the higher the ratio of the first near-infrared light, the longer the range at which obstacles can be recognized by the infrared night imaging vision apparatus. If the ratio of the first near-infrared light to the second near-infrared light is set to 0.1:1 to 0.33:1, the infrared night imaging vision apparatus can realize emission of near-infrared light that secures, with relatively low power consumption, a predetermined range at which obstacles can be recognized. If all near-infrared light emitted from the metal halide lamp is the first near-infrared light, the predetermined obstacle recognizable range can be secured with minimum power consumption. Actually, however, it is very difficult to realize this state.

The third metal halide lamp can reduce, to a realistic value, the power consumed for emission of near-infrared light.

A fourth metal halide lamp of the invention is similar to the first to third metal halide lamps, except that in the former, the metal storing means is formed of at least one of the electrodes, at least one electrode containing at least one selected from the group consisting of potassium (K), rubidium (Rb) and cesium (Cs).

This feature of the metal storing means of the fourth metal halide lamp is preferable. Since the metal storing means is formed of at least one of the electrodes, the fourth metal halide lamp ca have a simple structure, therefore an increase in cost can be avoided. It is sufficient if only one electrode serves as the metal storing means. However, it is more preferable if both electrodes serve as the metal storing means, in light of the discharge amount of stored metal and the manufacture of the lamp.

Furthermore, in the fourth metal halide lamp, at least one metal selected from potassium (K), rubidium (Rb) and cesium (Cs) can be added as a dopant to the main material, for example, tungsten, of the electrodes. In this case, the electrodes may contain, in addition to the above metal, aluminum (Al), calcium (Ca), iron (Fe), molybdenum (Mo), silicon (Si), chrome (Cr), etc. These metals are contained as dopants or impurities.

A fifth metal halide lamp of the invention is similar to the first to fourth metal halide lamps except that in the former, the discharge medium contains a halide of at least one selected from the group consisting of sodium (Na), scandium (Sc) and a rare earth metal.

This feature of the discharge medium is preferable. The above light emission metals mainly emit visible light highly efficiently. The fifth metal halide lamp may contain two of these metals. However, to highly efficiently emit white light, it is preferable that at least one metal selected from sodium (Na), scandium (Sc) and a rare earth metal is contained. For example, as a light source for vehicle headlights, it is preferable that sodium (Na) and scandium (Sc) are contained, and when necessary, a rare earth metal is also contained. Using the first halide as described above, white light falling within a chromaticity range stipulated in the vehicle headlight regulation (Japan Electric Lamp Manufacturers Association Regulation JEL215 1998) can be emitted highly efficiently. The rare earth metal includes, for example, dysprosium (Dy), thulium (Tm), etc.

A sixth metal halide lamp of the invention is similar to the first to fifth metal halide lamps except that in the former, the discharge medium contains a halide of at least one selected from the group consisting of potassium (K), rubidium (Rb) and cesium (Cs).

In the sixth metal halide lamp, at least one metal selected from potassium (K), rubidium (Rb) and cesium (Cs) is supplied from the metal storing means and a halide of the metal. If a halide of the metal is sealed in the hermetic vessel when the lamp is manufactured, this metal halide mainly emits near-infrared light upon ignition of the lamp, while the metal discharged from the metal storing means emits, along with the metal halide, near-infrared light with a high maintenance ratio through the life span of the lamp.

When the above metal is sealed in the form of a halide, the amount of the halide is set in accordance with the desired emission power ratio of near-infrared light with wavelengths of 780 to 1200 nm to visible light with wavelengths of 380 to 780 nm.

A seventh metal halide lamp of the invention is similar to the first to sixth metal halide lamps except that in the former, the discharge medium contains a first halide including a halide of at least one selected from the group consisting of sodium (Na), scandium (Sc) and a rare earth metal, the halide also containing a second halide including a halide of at least one selected from the group consisting of potassium (K), rubidium (Rb) and cesium (Cs), the halide further containing a third halide having a relatively high vapor pressure and being a halide of at least one kind of metal that emits a visible light less than that emitted by the metal of the first halide, the discharge medium containing substantially no mercury.

These features of the discharge medium are appropriate for use in a metal halide lamp for both a vehicle headlight and infrared night imaging vision apparatus. The chromaticity of visible light emitted from the seventh metal halide lamp is white that satisfies the above-mentioned regulation at and after the initial stage of lighting. The luminous flux of the lamp during stable lighting satisfies the regulation. Further, the lamp can secure a predetermined obstacle recognizable range for a long period. The lamp contains no mercury.

The third halide will now be described. The vapor pressure of the third halide is relatively high, which contributes to provision of a lamp voltage instead of mercury. Thus, a high lamp voltage is acquired without using mercury. Therefore, to operate the lamp, a relatively small lamp current flows through the lamp under the same input power. For realizing the above-described third halide, at least one metal selected from magnesium (Mg), iron (Fe), cobalt (Co), chrome (Cr), zinc (Zn), nickel (Ni), manganese (Mn), aluminum (Al), antimony (Sb), beryllium (Be), rhenium (Re), gallium (Ga), titanium (Ti), zirconium (Zr), hafnium (Hf), tin (Sn), etc. is contained therein.

Concerning mercury-free, a description will be given. In the invention, the feature that the discharge medium contains substantially no mercury means not only that no mercury is contained, but also that the existence of mercury of 0.5 to 1 mg, and in some cases, about 1.5 mg, per internal volume of 1 cc of the hermetic vessel is allowed. Of course, it is desirable for the environment to contain no mercury. However, that allowance is substantially very little, compared to the conventional cases where mercury of 20 to 40 mg, 50 mg or more in some cases, is contained per internal volume of 1 cc of a short-arc type hermetic vessel to increase the lamp voltage to a required value using mercury vapor.

An eighth metal halide lamp of the invention is similar to the first to seventh metal halide lamps except that in the former, the discharge medium mainly contains xenon (Xe).

The rare gas of the eighth metal halide lamp is preferable. That is, xenon (Xe) emits near-infrared light with wavelengths of 823.1 nm, 881.9 nm, 895.2 nm, 904.5 nm, 916.2 nm, 937.4 nm, 951.3 nm, 979.9 nm and 992.3 nm. That is, high emission power of near-infrared light can be acquired from xenon. FIG. 3 shows the spectral distribution of the lamp containing only xenon. Although in FIG. 3, the values after the decimal point are omitted for simplify the figure, the above-mentioned near-infrared distribution of xenon can be understood from the figure.

A ninth metal halide lamp of the invention is similar to the eighth metal halide lamp except that in the former, xenon (Xe) is sealed under the pressure of not less than six atoms.

The pressure of xenon (Xe) in the ninth metal halide lamp is preferable. In the case of using no mercury, xenon is used as a buffer gas to hold the temperature of plasma instead of mercury. The higher the pressure of xenon, the less the lamp heat loss and the higher the total luminous flux. Further, by virtue of xenon, near-infrared light with wavelengths of 820 to 1000 nm is increased. If xenon is sealed under the pressure of 6 atoms or more, the total luminous flux can satisfy the regulation for metal halide lamps for vehicle headlights, and near-infrared light with wavelengths of 750 to 1100 nm or wavelengths of 780 to 1200 nm is increased, thereby lengthening the obstacle recognizable range of the infrared night imaging vision apparatus. Assume here that the pressure of xenon is at room temperature, i.e., at 25° C.

A tenth metal halide lamp of the invention is similar to the first to ninth metal halide lamps, except that in the former, the electrodes are mainly formed of tungsten (W).

This feature of the electrodes is preferable. Since tungsten exhibits high resistance against fire and high electron emission capability, it is appropriate as the material of the electrodes of the metal halide lamp and is also appropriate if the electrodes serve as the metal storing means.

An eleventh metal halide lamp of the invention is similar to the first to tenth metal halide lamps, except that in the former, the metal storing means contains, with a concentration of 10 to 200 ppm, at least one metal selected from the group consisting of potassium (K), rubidium (Rb) and cesium (Cs).

The concentration of 10 to 200 ppm is a generally allowable concentration range. More preferably, at least one metal is contained with a concentration of 30 to 100 ppm.

The metal storing means of the eleventh metal halide lamp has a simple structure and preferable metal discharge characteristic.

A twelfth metal halide lamp of the invention is similar to the first to eleventh metal halide lamps, except that the former has a rated lamp power falling within a range of 35±3 W.

The twelfth metal halide lamp has rated lamp power that satisfies the regulation for HID lamps for vehicle headlights. If the lamp power falls within the above range, the rate input satisfies the regulation set for metal halide lamps for vehicle headlights. This range is substantially half the power of a halogen bulb light source for vehicle headlights.

The twelfth metal halide lamp satisfies the rated input stipulated in the regulation set for metal halide lamps for vehicle headlights.

A thirteenth metal halide lamp of the invention is similar to the first to twelfth metal halide lamps, except that the former is used for both a vehicle headlight and an infrared night imaging vision apparatus.

The thirteenth metal halide lamp may be simultaneously used for the vehicle headlight and infrared night imaging vision apparatus, or may be used for them at different times. In the latter case, when the lamp is used for the vehicle headlight, it is not used for the infrared night imaging vision apparatus, and vice versa.

The thirteenth metal halide lamp contributes to realization of a cost-effective illumination apparatus of a simple structure, such as a vehicle headlight, which is suitable in the case of simultaneously providing an infrared night imaging vision apparatus.

A fourteenth metal halide lamp of the invention is similar to the first to thirteenth metal halide lamps, except that the former mainly uses near-infrared light with wavelengths of not less than 750 nm when it is used for an infrared night imaging vision apparatus.

The wavelength range of 750 to 780 nm is part of the long wavelength range of visible light. However, in this wavelength range, the infrared night imaging vision apparatus exhibits a relatively high sensitivity. Therefore, if the emission power of visible light in this wavelength range is utilized for the infrared night imaging vision apparatus, in addition to the emission power of near-infrared light, higher emission power can be utilized for the apparatus. On the other hand, visible light with wavelengths of 380 to 750 nm can be utilized for the vehicle headlight. Although the light with the wavelengths of 750 to 780 nm cannot be utilized for the vehicle headlight, this does not significantly influence the visibility level of the vehicle headlight. This is because only part or the entire portion of red light of a very low spectral luminous efficiency is eliminated from the visible light for the vehicle headlight, and hence a change in chromaticity and luminous flux due to this elimination is almost ignorable.

In the fourteenth metal halide lamp, the near-infrared light used for the infrared night imaging vision apparatus contains light with wavelengths of 750 to 780 nm, therefore the infrared night imaging vision apparatus can generate a high-level output, which means that the obstacle recognizable range is increased.

A metal halide lamp lighting apparatus of the invention is characterized by comprising one of the first to fourteenth metal halide lamps and a lighting circuit for turning on the metal halide lamp.

The metal halide lamp lighting apparatus of the invention can be used for various illumination apparatuses using a metal halide lamp as a light source, for example, a vehicle headlight.

The lighting circuit is means for lighting a metal halide lamp, which is preferably digital means. However, if necessary, the lighting circuit may be mainly formed of a coil and iron core. Further, in the lighting circuit for vehicle headlights, if the maximum power supplied within four seconds after ignition of the metal halide lamp is set to 2 to 4 times, preferably, 2 to 3 times, the lamp power in a stable state, the luminous flux can quickly rise to a value falling within an intensity range necessary for vehicle headlights.

Further, assume here that the pressure of xenon sealed as a rare gas in the hermetic vessel is represented by X (atoms) falling within a range of 5 to 15 atoms, and the maximum power supplied within the four seconds after ignition of the metal halide lamp is represented by AA (W). In this case, if AA is higher than (−2.5X+102.5), within the four seconds after ignition of the metal halide lamp, the luminous flux can quickly rise, and a luminous intensity of 8000 cd at a representing point of the front surface of a vehicle headlight, necessary for vehicle headlights, can be acquired. The reason why the pressure of sealed xenon and the maximum input power have a linear relationship is that a discharge medium is a low vapor pressure besides Xe, and the light emitted from xenon is prevailing within the four seconds after ignition of the metal halide lamp. Since the luminous energy of xenon is determined from the pressure of xenon and power applied thereto, if the pressure of xenon is low, the input power should be increased, whereas if the pressure is high, the input power should be reduced. In the invention, the metal halide lamp may be lit using either an alternating current or direct current.

In addition, when necessary, the lighting circuit can be constructed such that its no-load output voltage is 200V or less. Compared to mercury-contained metal halide lamps, mercury-free metal halide lamps have a low lamp voltage, which enables the no-load output voltage of the lighting circuit to be set to 200V or less. As a result, the lighting circuit can be made compact.

DETAILED DESCRIPTION OF THE INVENTION

Figure 1:
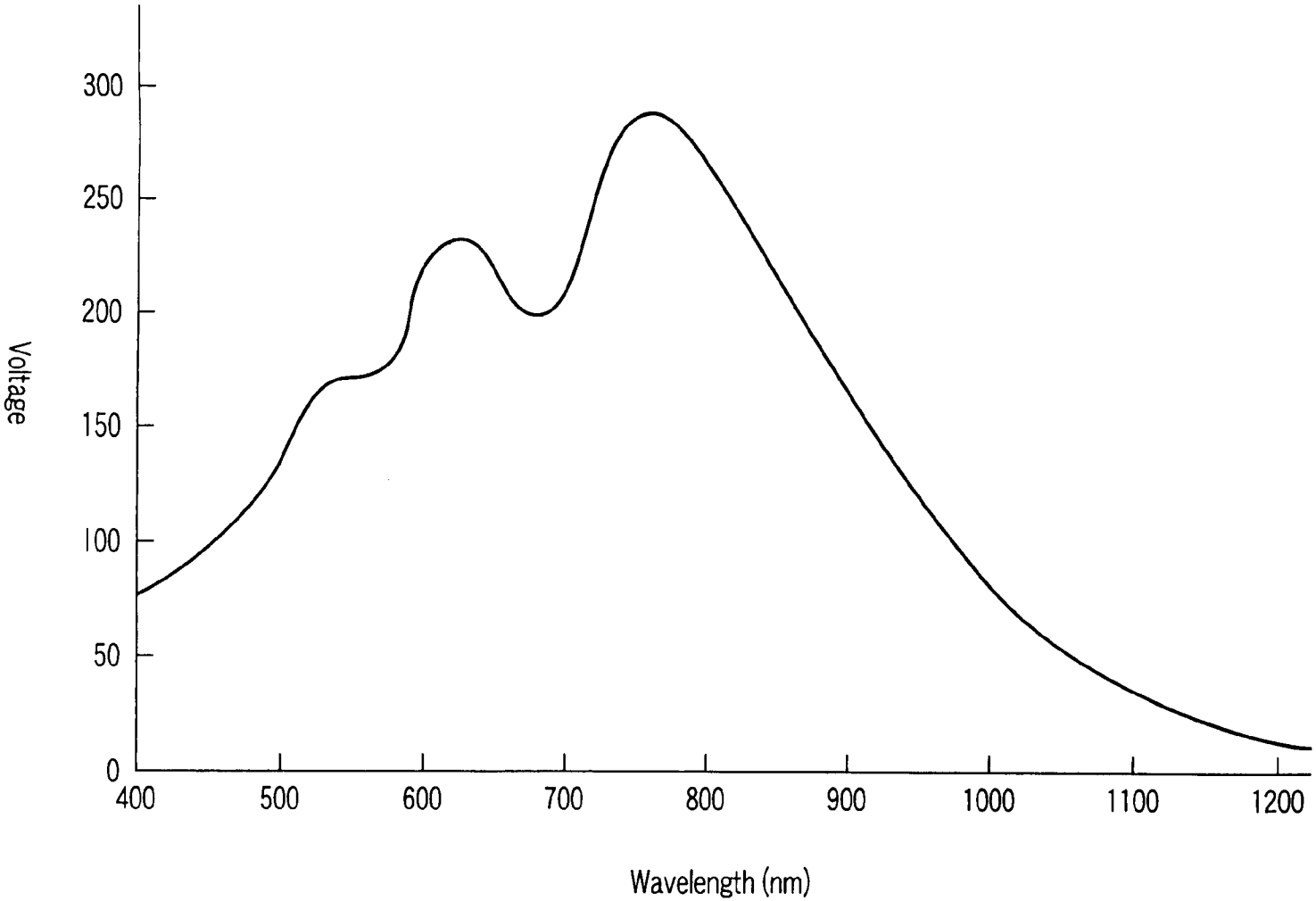
FIG. 1 is a graph illustrating the sensitivity characteristic of a generally used CCD camera.
Figure 2:
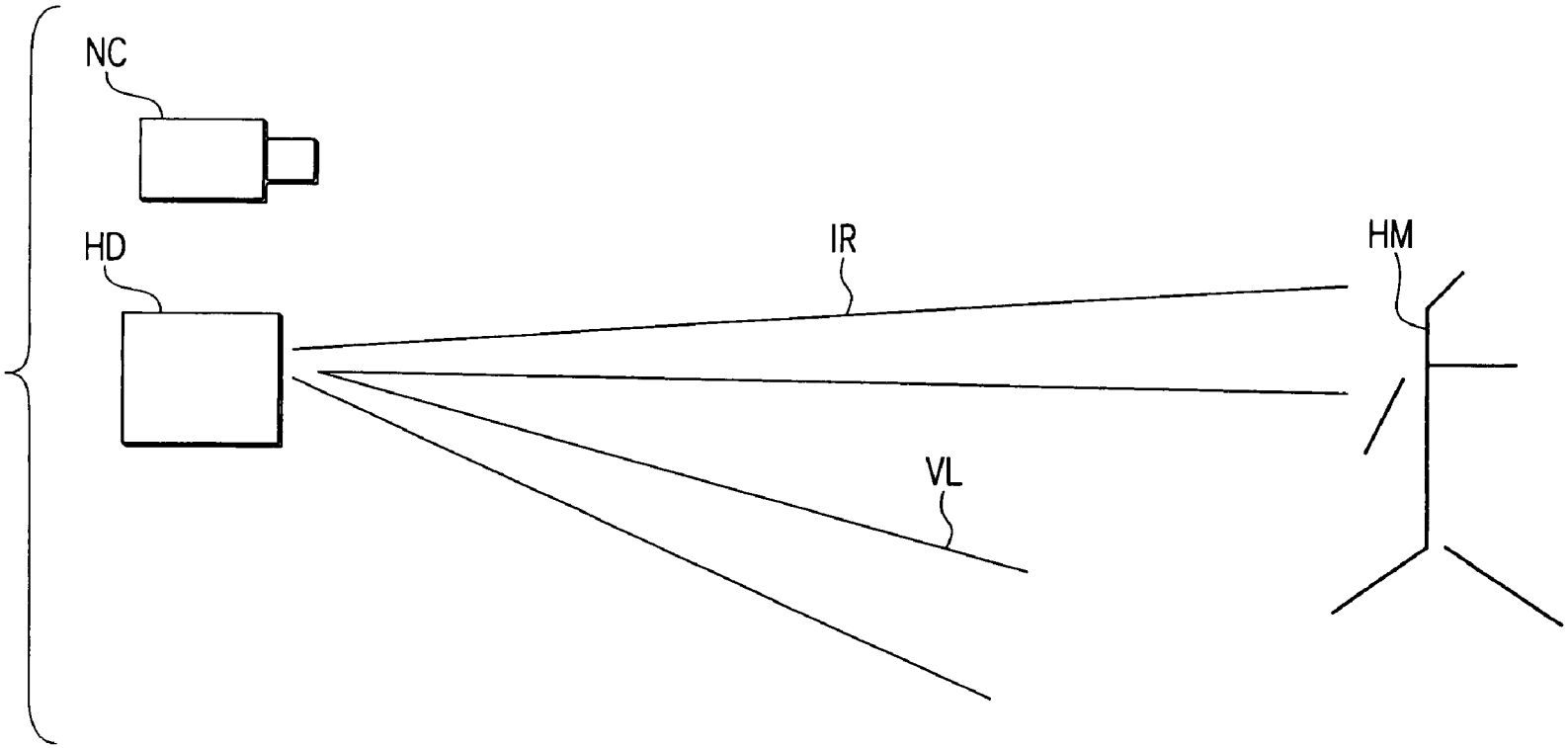
FIG. 2 is a conceptual view useful in explaining the operation principle of an active infrared night imaging vision apparatus.
Figure 3:
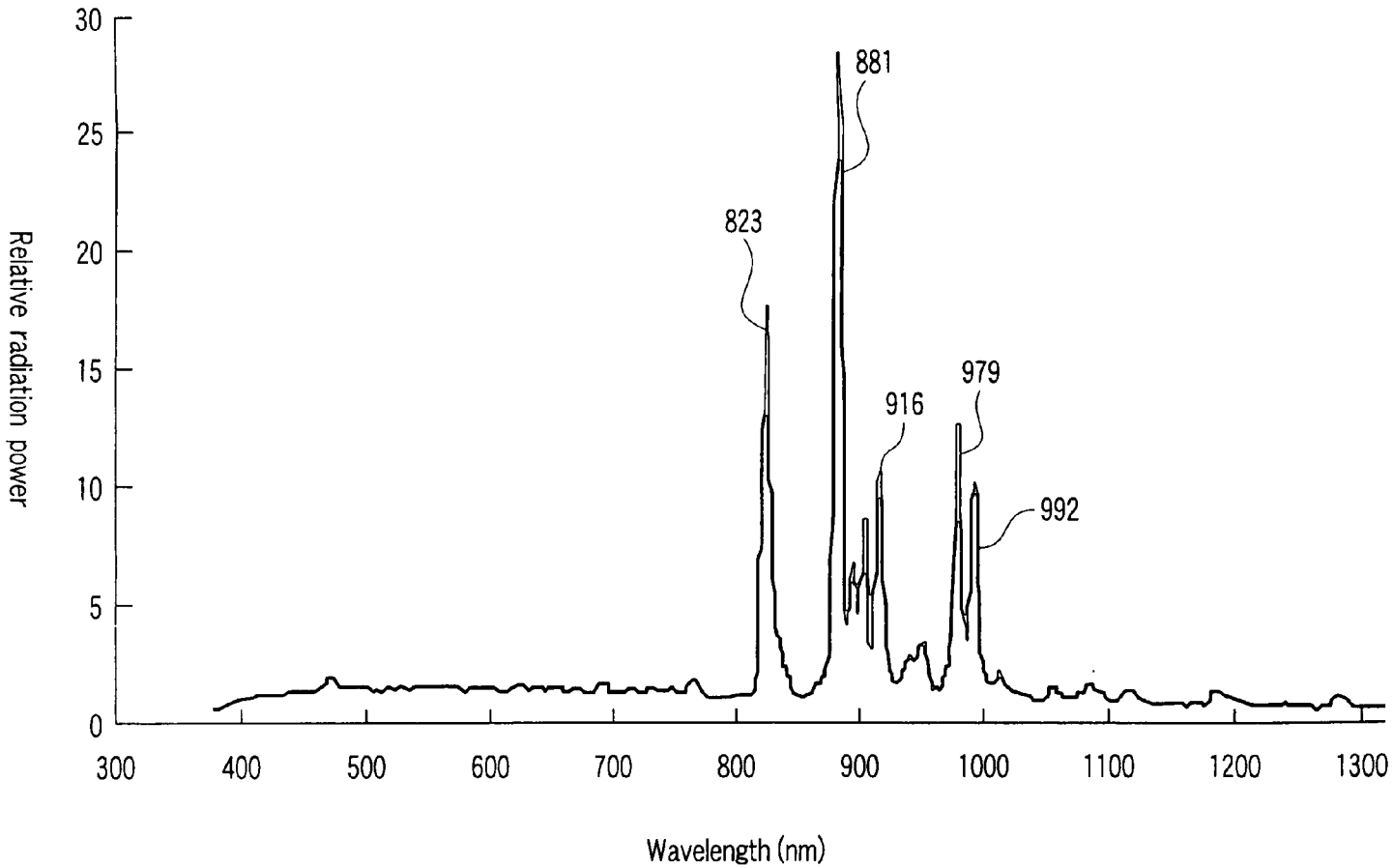
FIG. 3 is a graph illustrating the spectral distribution of a lamp filled with only xenon.
Figure 4:
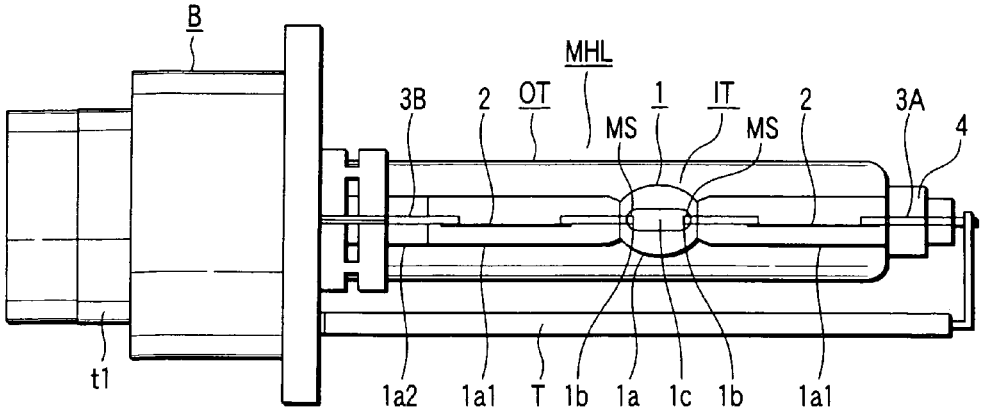
FIG. 4 is a front view illustrating the entire portion of a D4S-type lamp as a metal halide lamp according to a first embodiment of the invention.
Figure 5:
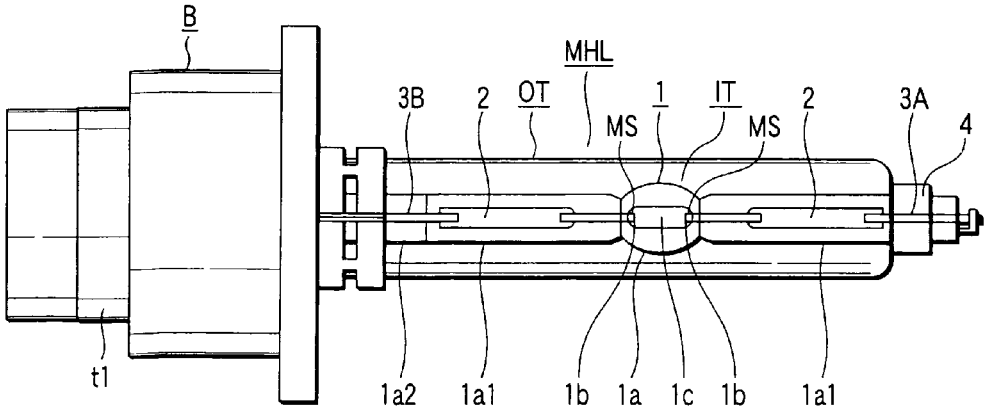
FIG. 5 is a plan view illustrating the entire portion of the D4S-type lamp as the metal halide lamp according to the first embodiment of the invention.

FIGS. 4 and 5 show a metal halide lamp according to a first embodiment of the invention. Specifically, FIG. 4 shows a front view illustrating the entire portion of a D4S-type lamp, and FIG. 5 is a plan view illustrating the same. As shown, the metal halide lamp MHL comprises a light emission tube IT, insulation tube T, outer tube OT and metal cap B.

The light emission tube IT includes a hermetic vessel 1, metal storing means MS, a pair of electrodes 1*b*, a pair of sealed metal leaves 2, a pair of external lead wires 3A and 3B and a discharge medium.

The hermetic vessel 1 includes a closing section 1*a* and a pair of sealing sections 1*a*1. The closing section 1*a* is a substantially cylindrical hollow member. The closing section 1*a* has its opposite ends provided with the slim sealing sections 1*a*1 formed integrally therewith as one body, and has a slim and substantially cylindrical discharge space 1*c*. The internal volume of the discharge space 1*c* is 0.05 cc or less.

The metal storing means MS stores at least one selected from potassium (K), rubidium (Rb) and cesium (Cs), and gradually discharges the stored metal in the hermetic vessel 1 through the life span of the lamp. Metal discharge is caused by the heat generated during lighting. The metal storing means MS is actually formed of the pair of electrodes 1*b*, described below.

The electrodes 1*b* are formed of tungsten wires that also serve as the metal storing means MS. These tungsten wires contain at least one metal of 10 to 200 ppm selected from potassium (K), rubidium (Rb) and cesium (Cs). Each electrode comprises a distal end, intermediate portion and proximal end, which axially extend and have the same diameter. The distal end and part of the intermediate portion project into the discharge space 1*c*. The portion of each electrode 1*b* projecting into the discharge space 1*c* serves as the metal storing means MS. Further, each electrode 1*b* has its proximal end welded to the corresponding buried metal foil 2, described later, and its intermediate portion loosely supported by the corresponding sealing section 1*a*1. Thus, each electrode 1*b* is kept in a predetermined position in the hermetic vessel 1.

In FIGS. 4 and 5, after the left sealing section 1*a*1 is formed, a sealing tube 1*a*2 forming the sealing section 1*a*1 is not cut but extended to the metal cap B from the bottom of the sealing section 1*a*1.

The sealed metal foils 2 are formed of molybdenum foils and airtightly buried in the sealing sections 1*a*1 of the hermetic vessel 1.

The discharge medium comprises first to third halides and a rare gas. The first halide contains at least one metal selected from sodium (Na), scandium (Sc) and a rare-earth metal. The second halide contains a metal halide that mainly emits light with wavelengths of 750 to 1100 nm, i.e., near-infrared light. The third halide comprises a halide having a relatively high vapor pressure and being a halide of at least one kind of metal that emits a visible light less than that emitted by the metal of the first halide. The rare gas is xenon gas.

The pair of external lead wires 3A and 3B have their distal ends welded to the other ends of the sealed metal leaves 2 in the sealing sections 1*a*1 of the hermetic vessel 1, and have their proximal ends lead to the outside of the respective sealing sections 1*a*1. The external lead wire 3A, lead to the right in FIG. 4 or 5 from the discharge (light emission) tube IT, has its intermediate portion folded along the outer tube OT, described later. The wire 3A is then guided into the metal cap B, described later, and connected to a ring-shaped metal cap terminal t1 provided on the outer peripheral surface of the cap B. The external lead wire 3B, lead to the left in FIG. 4 or 5 from the discharge tube IT along the axis of the vessel, is extended along the axis, guided into the metal cap B and connected to the other pin-shaped metal cap terminal (not shown) provided at the center of the cap B.

The outer tube OT, which contains the discharge tube IT, has an ultraviolet-ray cutting function. The outer tube OT has opposite small-diameter portions 4 (only the right small-diameter portion 4 is shown) welded to the respective sealing sections 1*a*1. However, the outer tube OT is not airtight but communicates with the outside air.

The insulation tube T is made of ceramic and covers the external lead wire 3A.

The metal cap B is a standardized one as a component of a metal halide lamp for vehicle headlights, and is constructed such that it extends coaxial with the discharge tube IT and outer tube OT, and can be mounted on and dismounted from the back surface of a vehicle headlight. Further, the metal cap B includes the ring-shaped metal cap terminal t1 and the other pin-shaped metal cap terminal. The terminal t1 is provided on the outer surface of the cylindrical portion of the cap B such that it can be connected to a power-supply side lamp socket when the lamp is mounted. The other pin-shaped terminal is provided in a recess formed in the cylindrical portion, axially projecting at the center of the recess.

During stable lighting, the metal halide lamp constructed as above utilizes visible light with wavelengths of 380 to 780 nm and near-infrared light with wavelengths of 750 to 1100 nm, the emission power ratio of the former to the latter being set to from 0.5:1 to 4.0:1. Alternatively, the metal halide lamp utilizes visible light with wavelengths of 380 to 780 nm and near-infrared light with wavelengths of 780 to 1200 nm, the emission power ratio of the former to the latter being set to from 2.0:1 to 3.2:1.

EXAMPLE 1

The metal halide lamp of FIG. 4 according to the first embodiment of the invention has the following specifications:

Discharge tube (light emission tube) IT

Hermetic vessel 1*a*: Made of quartz glass; Bulb length of 7 mm; Maximum outer diameter of 6 mm; Entire length of 50 mm; Maximum inner diameter of 2.6 mm; Internal volume of 0.025 cc.

Metal storing means MS: Formed of the portion of each electrode projecting into the hermetic vessel; Formed of a tungsten wire mainly doped with 66 ppm of potassium (concerning the doped components, see Table 1)

Electrode 1*b*: Formed of a doped tungsten wire with a diameter of 0.35 mm; Inter-electrode distance of 4.2 mm; Projection length of 1.3 mm Discharge Medium First halide: 0.26 mg of NaI; 0.13 mg of $ScI_3$ Second halide: 0.04 mg of RbI Third halide: 0.2 mg of $ZnI_2$ Rare gas: 10 atoms of xenon (Xe)

Outer tube OT: Outer diameter of 9 mm; Inner diameter of 7 mm; Internal pressure=atmospheric pressure (internal atmosphere=outside air)

Power upon ignition: 86 W

Rated lamp power: 35 W

Emission power ratio (during stable lighting):

Visible light (380 to 780 nm)/near-infrared light (750 to 1100 nm)=2.37

Visible light (380 to 780 nm)/near-infrared light (780 to 1200 nm)=2.61 first near-infrared light (780 to 800 nm)/second near-infrared light (780 to 1000 nm)=0.24

TABLE 1

| Doped component | K | Al | Ca | Fe | Mo | Si |
|---|---|---|---|---|---|---|
| Content (ppm) | 60 | 4.2 | <0.1 | <0.1 | <10 | <10 |

In the following Table 2, only the electrode material is varied between the shown metal halide lamps, and the other specifications of the shown lamps are similar to those of example 1. Specifically, Table 2 shows the types of doped components, the luminous flux maintenance ratio at 3000 hours after lighting (the ratio of the total luminous flux at 3000 hours after lighting to that of the initial time), and the near-infrared emission power maintenance (the ratio of the emission power of near-infrared light of 750 to 1200 nm at 3000 hours after lighting to that of the initial time). The lamps were tested at the switching cycle stipulated in Japan Electric Lamp Manufacturers Association Regulation JEL215 1998. Further, each value in Table 2 is the average of two lamps.

TABLE 2

| Lamp | $ThO_2$ (weight %) | K (ppm) | Rb (ppm) | Cs (ppm) | Luminous flux maintenance ratio (%) | Near-infrared emission power maintenance ratio (%) |
|---|---|---|---|---|---|---|
| A | | | | | 62 | 58 |
| B | 1.0 | | | | 71 | 68 |
| C | 1.0 | 60 | | | 71 | 95 |
| D | | 10 | | | 66 | 78 |
| E | | 30 | | | 67 | 90 |
| F | | 60 | | | 68 | 95 |
| G | | 100 | | | 68 | 102 |
| H | | 150 | | | 67 | 110 |
| I | | 200 | | | 67 | 115 |
| J | 1.0 | | 60 | | 72 | 96 |
| K | | | 10 | | 65 | 76 |
| L | | | 30 | | 67 | 91 |
| M | | | 60 | | 68 | 96 |
| N | | | 100 | | 68 | 101 |
| O | | | 150 | | 67 | 112 |
| P | | | 200 | | 67 | 118 |
| Q | 1.0 | | | 60 | 72 | 94 |
| R | | | | 10 | 68 | 79 |
| S | | | | 30 | 68 | 91 |
| T | | | | 60 | 69 | 96 |
| U | | | | 100 | 68 | 99 |
| V | | | | 150 | 69 | 108 |
| W | | | | 200 | 67 | 116 |

In Table 2, lamps A and B are conventional ones. Lamp A has electrodes made of pure tungsten. Lamp B has electrodes made of thoriated tungsten containing a 1.0% thorium oxide ($ThO_2$).

In Table 2, lamps C to W are example 1 and its modifications according to the first embodiment of the invention. Specifically, lamp C is example 1, and the other lamps are its modifications. Among these lamps, in the lamps having electrodes containing potassium (K), the amount of emission of K is increased with time in the near-infrared area during long-term lighting. Similarly, in the lamps having electrodes containing cesium (Cs), the amount of emission of Cs is increased with time in the near-infrared area during long-term lighting. Further, in the lamps having electrodes containing rubidium (Rb), the amount of emission of Rb sealed as the second halide is increased with time in the near-infrared area during long-term lighting.

Figure 6:
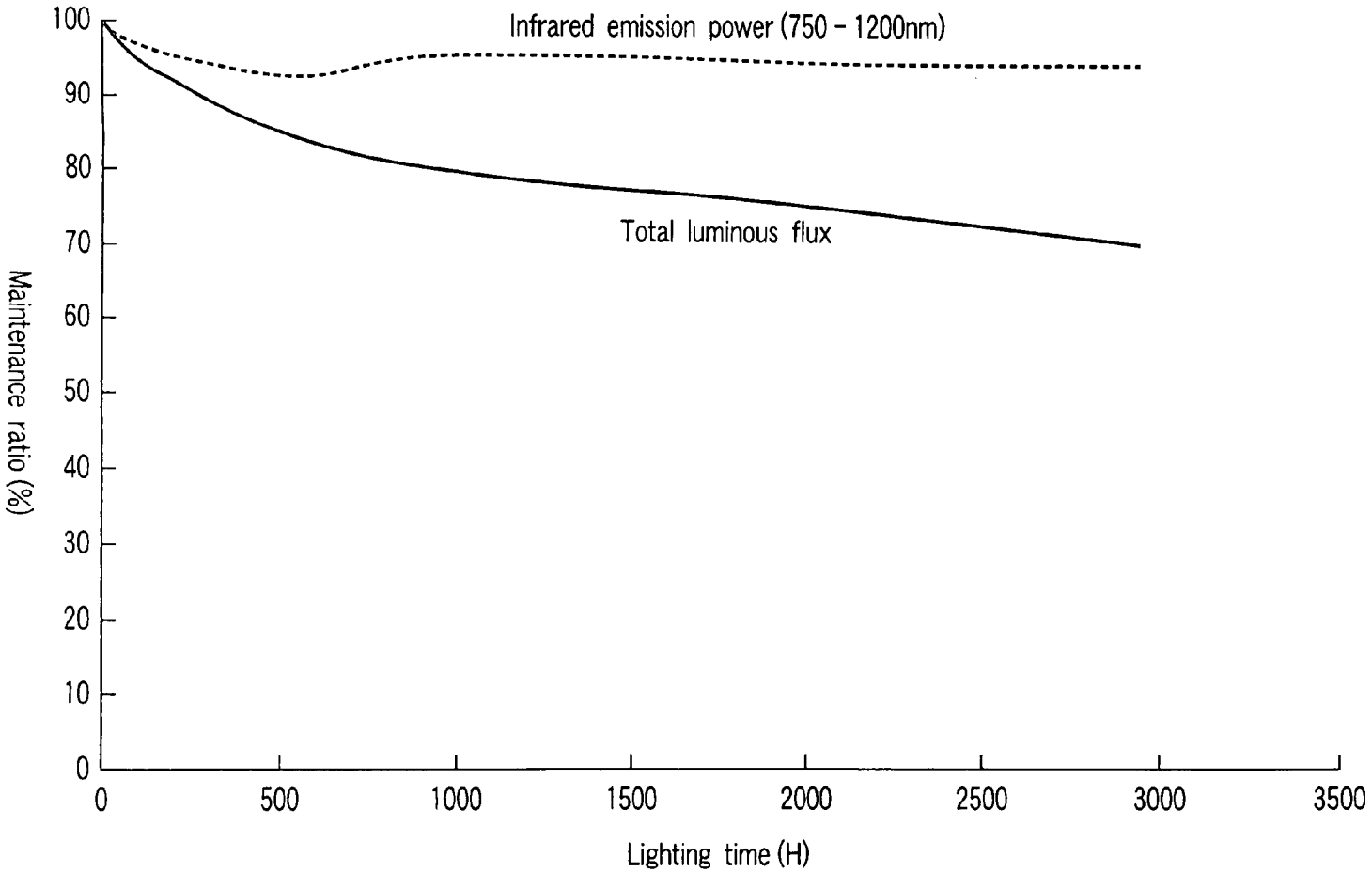
FIG. 6 is a graph illustrating the luminous flux maintenance ratio characteristic and near-infrared emission power maintenance ratio characteristic in a metal halide lamp according to example 1 of the first embodiment.

FIG. 6 is a graph illustrating the luminous flux maintenance ratio characteristic and near-infrared emission power maintenance ratio characteristic in the metal halide lamp according to example 1 of the first embodiment. In FIG. 6, the solid-line curve designated as "Total luminous flux" indicates the luminous flux maintenance ratio characteristic of visible light, and the broken-line curve designated as "Infrared emission power (750 to 1200 nm) indicates the near-infrared emission power maintenance ratio characteristic of infrared light of 750 to 1200 nm.

As can be understood from FIG. 6, in example 1, the total luminous flux is gradually reduced with time during lighting. On the other hand, the infrared emission power is little reduced with time and maintained substantially constant after about 800 hours elapse, since the metal storing means MS is heated during lighting and discharges potassium (K), this discharge being gradually performed through the life span of the lamp. Depending upon the case, the near-infrared emission power becomes higher than at the initial stage of lighting. By virtue of this, the infrared night imaging vision function little changes even after 3000 hours elapse from lighting.

Figure 7:
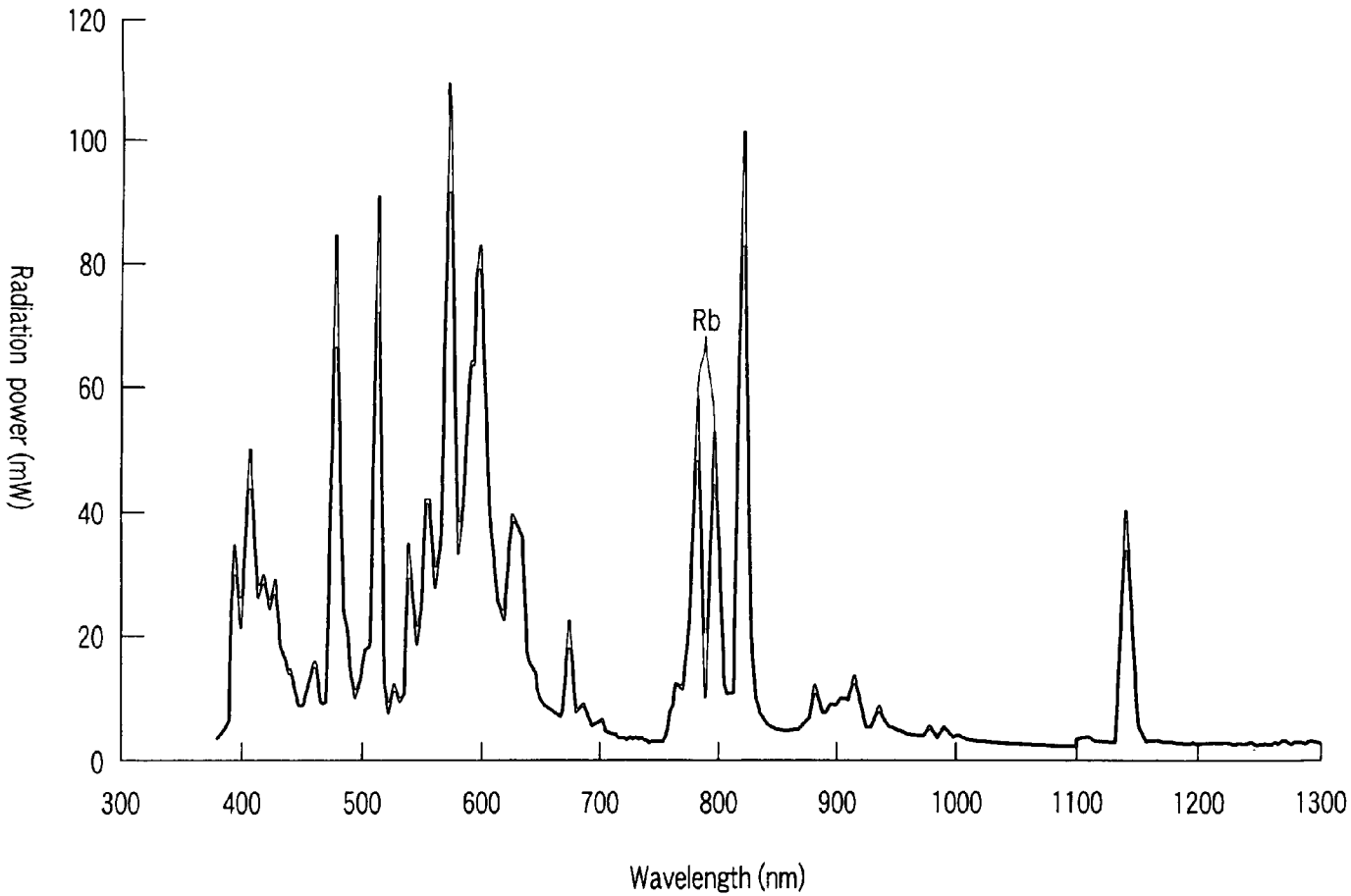
FIG. 7 is a graph illustrating the spectral distribution curve of light with wavelengths of 380 to 1300 nm acquired at the initial time in the metal halide lamp according to example 1 of the first embodiment.
Figure 8:
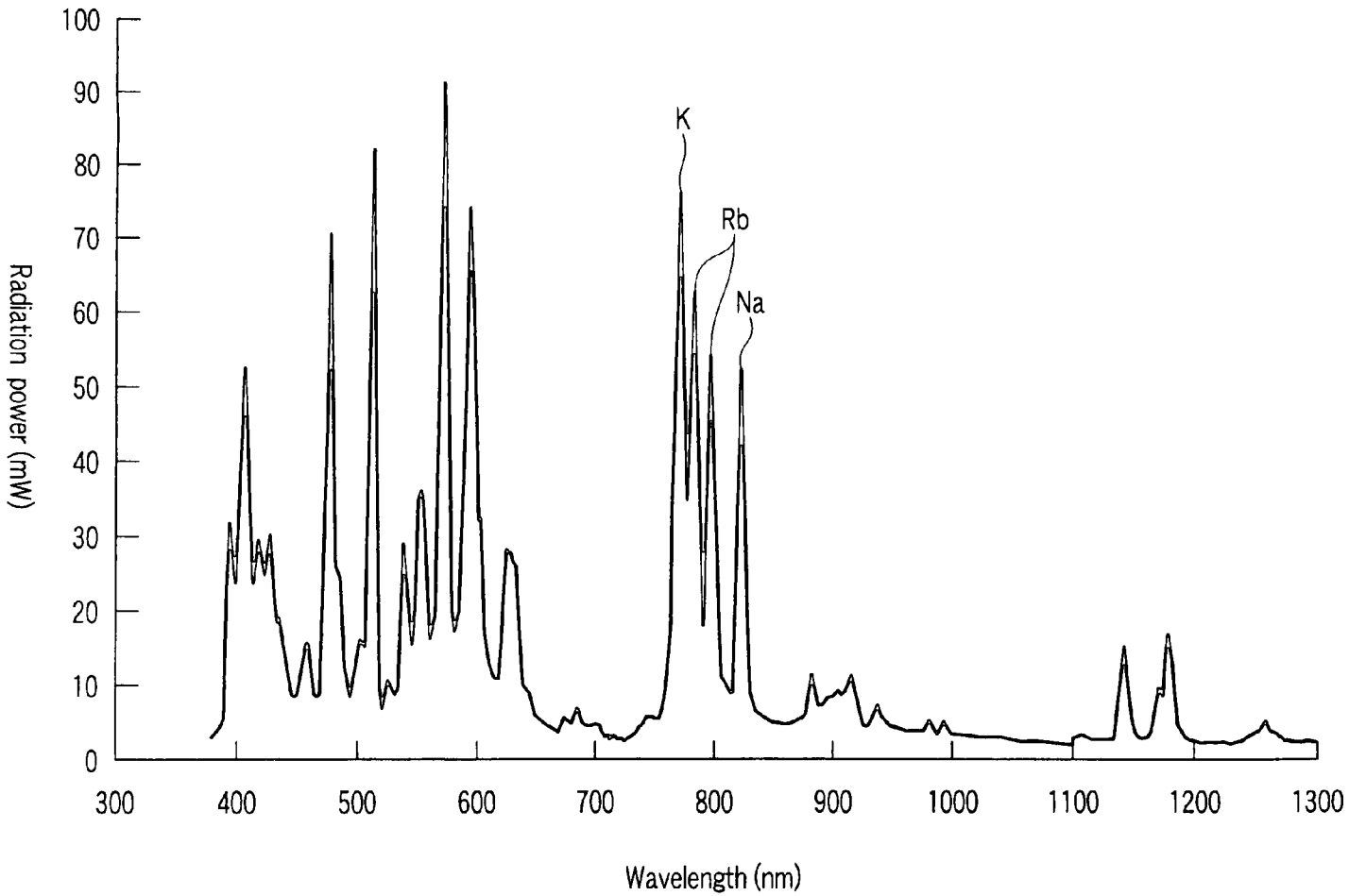
FIG. 8 is a graph illustrating the spectral distribution curve acquired 3000 hours after lighting.

FIG. 7 illustrates the spectral distribution of light of 380 to 1300 nm at the initial time in the metal halide lamp according to example 1 of the first embodiment. FIG. 8 illustrates the spectral distribution of the light assumed 3000 hours after lighting.

As can be understood from the figures, there is no emission of potassium (K) at the initial stage of lighting, whereas potassium (K) radiates high emission power 3000 hours after lighting. As a result, the metal halide lamp exhibits the excellent near-infrared emission power maintenance ratio characteristic as shown in FIG. 6. The emission power of sodium (Na) line of 818.3 nm and 819.4 nm is lower 3000 hours after than at the initial stage.

Figure 9:
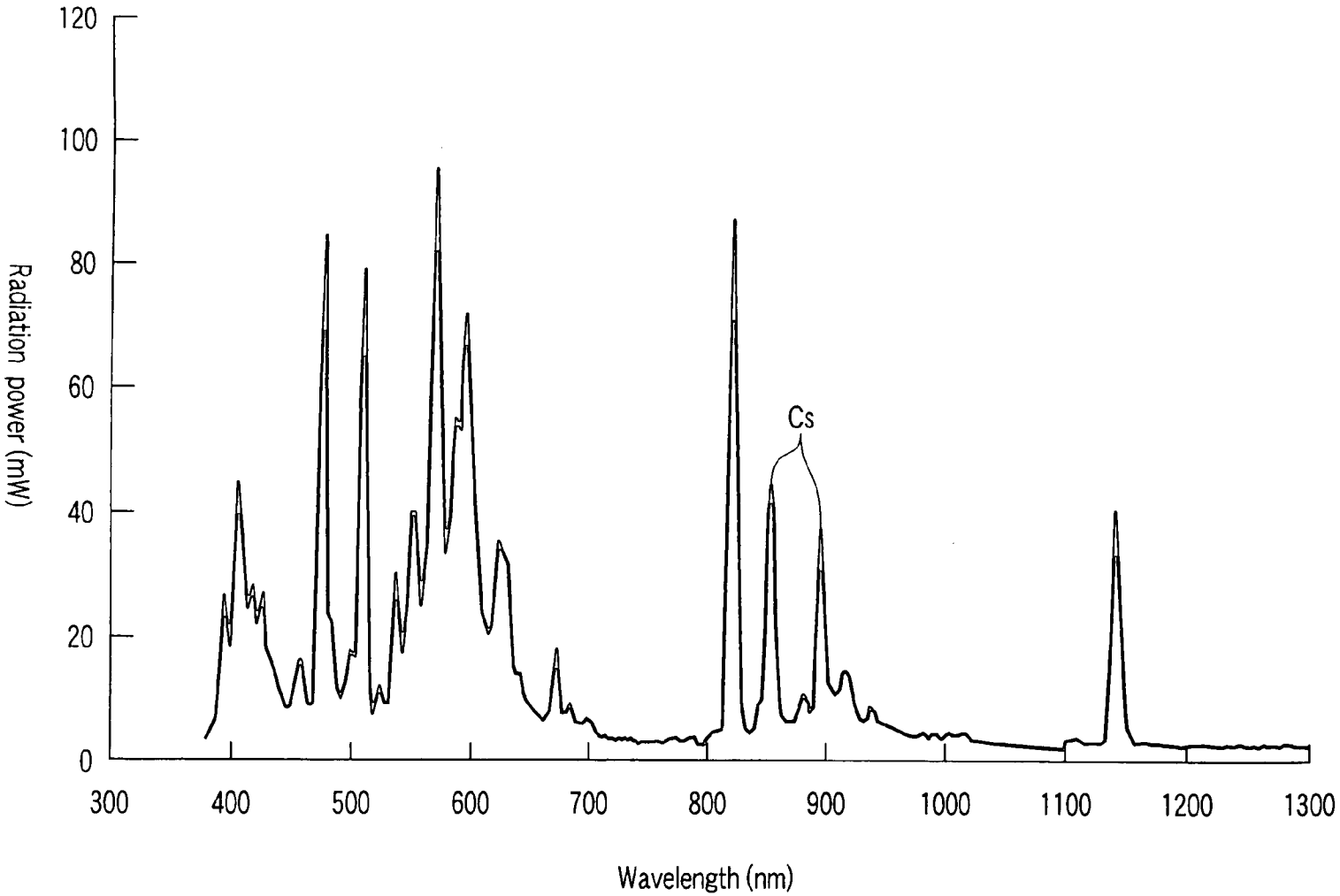
FIG. 9 is a graph illustrating the spectral distribution characteristic curve of light of 380 to 1300 nm of a metal halide lamp at the initial time according to a modification of the first embodiment, in which a halide of cesium (Cs) is sealed as the second halide instead of a halide of rubidium (Rb)

FIG. 9 is a graph illustrating the spectral distribution characteristic curve of light of 380 to 1300 nm upon ignition of a metal halide lamp according to a modification of the first embodiment, in which a halide of cesium (Cs) is sealed as the second halide instead of a halide of rubidium (Rb).

EXAMPLE 2

A metal halide lamp according to example 2 of the first embodiment of the invention has specifications below, the other specifications being similar to those of example 1.

Electrode 1*b*: Formed of a doped tungsten wire with a diameter of 0.38 mm

Discharge medium

First halide: 0.5 mg of NaI; 0.1 mg of $ScI_3$

Second halide: 0.4 mg of CsI

Third halide: 0.2 mg of $ZnI_2$

Rated lamp power: 40 W

Emission power ratio (during stable lighting):

Visible light (380 to 780 nm)/near-infrared light (750 to 1100 nm)=0.82

In the following Table 3, only the electrode material is varied between the shown metal halide lamps, and the other specifications of the shown lamps are similar to those of example 2. Specifically, Table 3 shows the types of doped components, the luminous flux maintenance ratio 3000 hours after lighting (the ratio of the total luminous flux 3000 hours after lighting to that of the initial time), and the near-infrared emission power maintenance (the ratio of the emission power of near-infrared light of 750 to 1200 nm 3000 hours after lighting to that of the initial time). To provide the data shown in Table 3, the lamps were tested in the same manner as in the case of providing the data of Table 2.

TABLE 2

| Lamp | $ThO_2$ (weight %) | K (ppm) | Rb (ppm) | Cs (ppm) | Luminous flux maintenance ratio (%) | Near-infrared emission power maintenance ratio (%) |
|---|---|---|---|---|---|---|
| A | | | | | 64 | 62 |
| B | 1.0 | | | | 73 | 70 |
| C | 1.0 | 60 | | | 73 | 97 |
| D | | 10 | | | 68 | 80 |
| E | | 30 | | | 69 | 92 |
| F | | 60 | | | 70 | 97 |
| G | | 100 | | | 71 | 102 |

TABLE 2-continued

| Lamp | $ThO_2$ (weight %) | K (ppm) | Rb (ppm) | Cs (ppm) | Luminous flux maintenance ratio (%) | Near-infrared emission power maintenance ratio (%) |
|---|---|---|---|---|---|---|
| H | | 150 | | | 69 | 108 |
| I | | 200 | | | 67 | 110 |
| J | 1.0 | | 60 | | 72 | 98 |
| K | | | 10 | | 68 | 78 |
| L | | | 30 | | 69 | 93 |
| M | | | 60 | | 69 | 98 |
| N | | | 100 | | 69 | 103 |
| O | | | 150 | | 68 | 110 |
| P | | | 200 | | 67 | 116 |
| Q | 1.0 | | | 60 | 72 | 97 |
| R | | | | 10 | 68 | 81 |
| S | | | | 30 | 68 | 93 |
| T | | | | 60 | 69 | 98 |
| U | | | | 100 | 68 | 101 |
| V | | | | 150 | 69 | 110 |
| W | | | | 200 | 67 | 118 |

As can be understood from Table 3, the same tendency as in example 1 is found in example 2. However, since the amounts of near-infrared emission substances (K, Rb, Cs) sealed are larger than those in example 1, the ratio of change is lower and the near-infrared emission power maintenance ratio acquired 3000 hours after lighting is higher in example 2. When the metal storing means stores potassium (K), the emission amount of K is increased in the near-infrared area during long-term lighting. Similarly, when the metal storing means stores rubidium (Rb), the emission amount of Rb is increased in the near-infrared area during long-term lighting. Further, when the metal storing means stores cesium (Cs), the emission amount of Cs is increased in the near-infrared area during long-term lighting.

Figure 10:
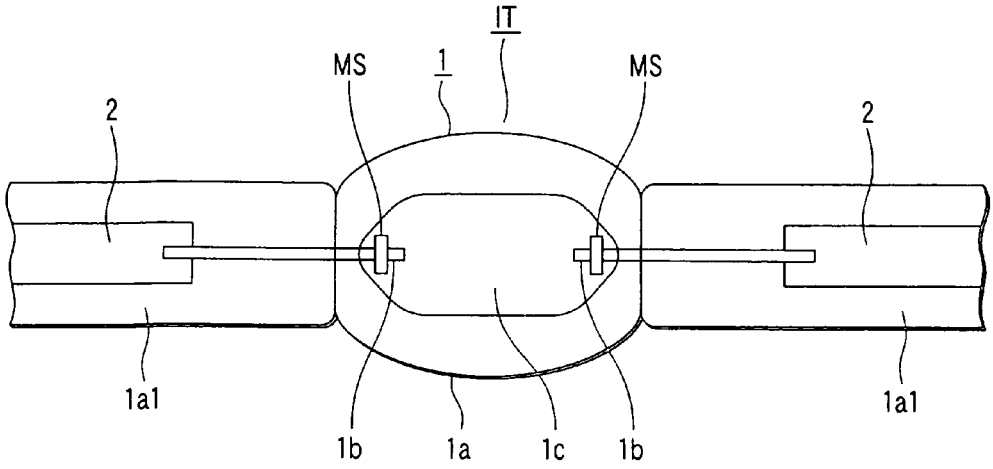
FIG. 10 is a partially broken front view illustrating a light emission tube incorporated in a metal halide lamp according to a second embodiment of the invention.

FIG. 10 is a partly broken front view illustrating a metal halide lamp according to a second embodiment of the invention. The second embodiment is similar to the first embodiment in that the light emission tube IT comprises a hermetic vessel 1, metal storing means MS, a pair of electrodes 1*b*, a pair of sealed metal foils 2, a pair of external lead wires 3A and 3B and a discharge medium. However, the former differs from the latter in that in the former, the metal storing means MS is formed separately from the pair of electrodes 1*b*.

Specifically, the metal storing means MS stores at least one selected from potassium (K), rubidium (Rb) and cesium (Cs), and gradually discharges the stored metal in the hermetic vessel 1 through the life span of the lamp. Metal discharge is caused by the heat generated during lighting. The metal storing means MS is formed of tungsten (base metal) doped with at least one metal, and is welded to the axially middle portion of each electrode 1*b* such that, for example, it intersects each electrode 1*b*.

Each electrode 1*b* is formed of pure tungsten.

Figure 11:
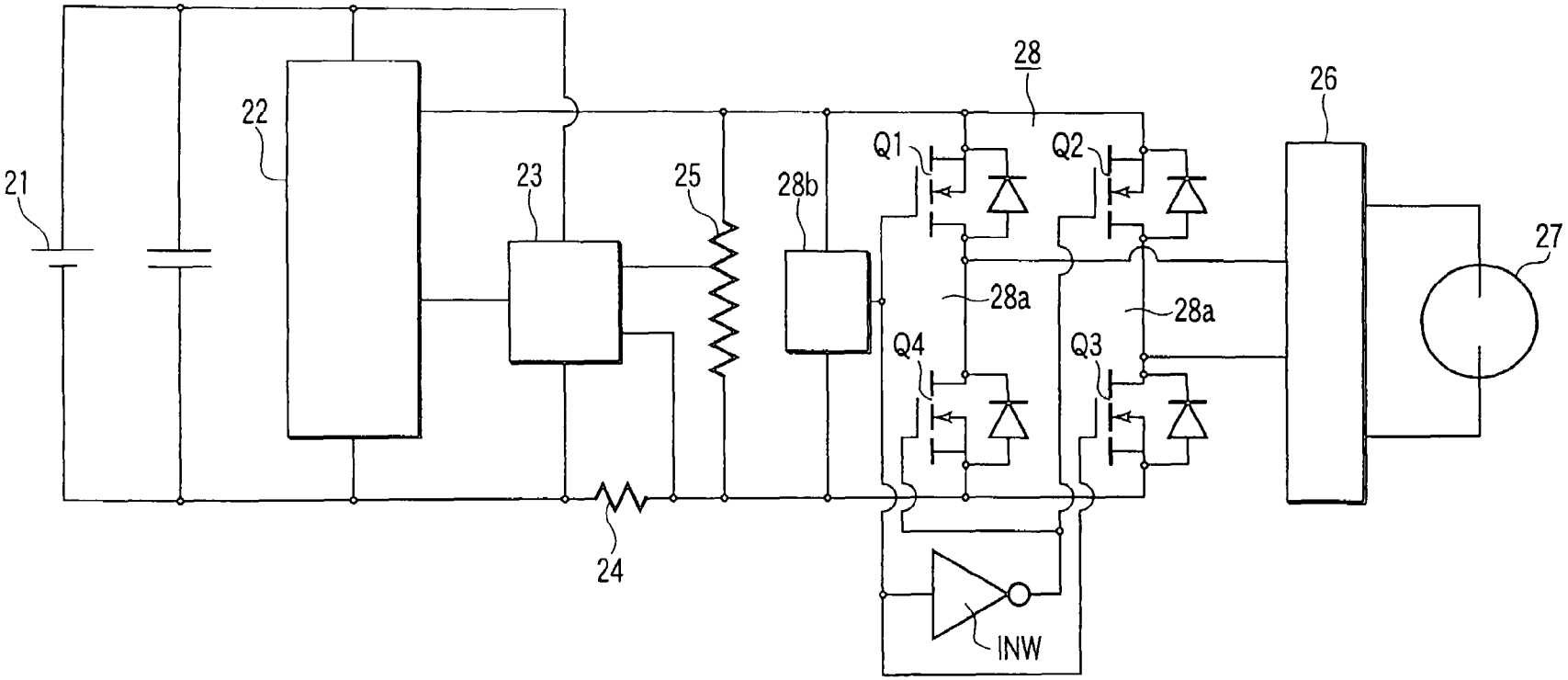
FIG. 11 is a circuit diagram illustrating a metal halide lamp lighting device according to the invention.

FIG. 11 is a circuit diagram illustrating the structure of a metal halide lamp lighting device according to the invention. As shown, the metal halide lamp lighting device comprises a metal halide lamp 27 and lighting circuit OC.

The metal halide lamp 27 may have a structure similar to the first or second embodiment.

The lighting circuit OC comprises a direct-current power supply 21, chopper 22, control means 23, lamp current detection means 24, lamp voltage detection means 25, igniter 26 and full-bridge inverter 28. The lighting circuit OC powers the metal halide lamp using a direct current upon ignition, and thereafter powers it using an alternating current.

The direct-current power supply 21 is used to supply a direct current to the chopper 22, described later, and is formed of a battery or rectified direct-current power supply. In the case of vehicles, a battery is generally used. However, a rectified direct-current power supply for rectifying an alternating current may be used. When necessary, an electrolytic condenser 21*a* is connected in parallel with the power supply to absorb the noise generated by the power supply or smooth the level of power.

The chopper 22 is a DC-DC converter circuit for converting a direct-current voltage into a predetermined direct-current voltage, and is disposed to control the voltage applied to the metal halide lamp 27 via the full-bridge inverter 28. When the direct-current power supply voltage is low, a booster chopper is used, while when it is high, a step-down chopper is used.

The control means 23 controls the chopper 22. For example, immediately after turn-on of the lamp, the control means 23 supplies the metal halide lamp 27 with a lamp current three times or more the rated lamp current, using the chopper 22 via the full-bridge inverter 28. With lapse of time, the control means 23 gradually reduces the lamp current to the rated lamp current. Further, the control means 23 generates a constant power control signal to control the chopper 22 using a constant power, when detection signals corresponding to the lamp current and lamp voltage are fed back thereto. The control means 23 contains a microcomputer prestoring a temporal control pattern, which enables the above-mentioned control of supplying the metal halide lamp 27 with the lamp current three times or more the rated lamp current, and gradually reducing the lamp current to the rated lamp current with time.

The lamp current detection means 24 is connected in series to the metal halide lamp 27 via the full-bridge inverter 28, and used to detect a current corresponding to the lamp current and input it to the control means 23.

The lamp voltage detection means 25 is connected in parallel with the metal halide lamp 27 via the full-bridge inverter 28, and used to detect a voltage corresponding to the lamp voltage and input it to the control means 23.

The igniter 26 is interposed between the full-bridge inverter 28 and metal halide lamp 27 and disposed to supply the metal halide lamp 27 with a start pulse voltage of about 20 kV at the start of lighting.

The full-bridge inverter 28 comprises a bridge circuit 28*a* formed of four MOSFETs Q1, Q2, Q3 and Q4, a gate drive circuit 28*b* for alternately switching the MOSFETs Q1, Q2, Q3 and Q4, and a polarity inverting circuit INV. The full-bridge inverter 28 converts a direct-current voltage from the chopper 2 into a low-frequency alternating voltage of a rectangular waveform by utilizing the alternate switching, and applies it to the metal halide lamp 27 to light it (low-frequency alternating-current lighting). During direct-current lighting immediately after ignition of the lamp, the MOSFETs Q1 and Q3, for example, of the bridge circuit 28*a* are kept on, and the MOSFETs Q2 and Q4 are kept off.

Using the lighting circuit OC constructed as above, firstly a direct current and then a low-frequency alternating current are supplied to the metal halide lamps 27, with the result that the lamp emits a predetermined luminous flux upon turn-on. If the metal halide lamp lighting device of the invention is incorporated in a vehicle headlight, 25% of the rated flux is realized one second after ignition, and 80% is realized four seconds after.

What is claimed is:

1. A metal halide lamp comprising:

a refractory, light-transmitting hermetic vessel;

a pair of electrodes sealed in the hermetic vessel;

a discharge medium including a halide and a rare gas; and metal storing means storing at least one selected from the group consisting of potassium (K), rubidium (Rb) and cesium (Cs), the metal storing means being heated during lighting and gradually discharging the at least one metal in the hermetic vessel, wherein an emission power ratio of visible light with wavelengths of 380 to 780 nm to near-infrared light with wavelengths of 750 to 1100 nm is 0.5:1 to 4.0:1 during stable lighting, and wherein the halide of the discharge medium contains a halide of at least one selected from the group consisting of potassium (k), rubidium (RB) and cesium (Cs).

2. The metal halide lamp according to claim 1, wherein an emission power ratio of first near-infrared light with wavelengths of 780 to 800 nm to second near-infrared light with wavelengths of 780 to 1000 nm is 0.1:1 to 0.33:1 during stable lighting.

3. The metal halide lamp according to claim 1, wherein the metal storing means is formed of at least one of the electrodes, at least one electrode containing at least one selected from the group consisting of potassium (K), rubidium (Rb) and cesium (Cs).

4. The metal halide lamp according to claim 1, wherein the halide of the discharge medium contains a halide of at least one selected from the group consisting of sodium (Na), scandium (Sc) and a rare earth metal.

5. The metal halide lamp according to claim 1, wherein the rare gas of the discharge medium mainly contains xenon (Xe).

6. The metal halide lamp according to claim 5, wherein xenon (Xe) is sealed under a pressure of not less than six atoms.

7. The metal halide lamp according to claim 1, wherein the electrodes are mainly formed of tungsten (W).

8. The metal halide lamp according to claim 1, wherein at least one selected from the group consisting of potassium (K), rubidium (Rb) and cesium (Cs) contained in the metal storing means has a concentration of 10 to 200 ppm.

9. The metal halide lamp according to claim 1, wherein the metal halide lamp has a rated lamp power falling within a range of 35±3 W.

10. The metal halide lamp according to claim 1, wherein the metal halide lamp is used for both a vehicle headlight and an infrared night imaging vision apparatus.

11. The metal halide lamp according to claim 1, wherein the metal halide lamp mainly uses near-infrared light with wavelengths of not less than 750 nm when the metal halide lamp is used for an infrared night imaging vision apparatus.

12. A metal halide lamp lighting apparatus comprising:

the metal halide lamp according to claim 1; and a lighting circuit which turns on the metal halide lamp.

13. A metal halide lamp comprising:

a refractory, light-transmitting hermetic vessel;

a pair of electrodes sealed in the hermetic vessel;

a discharge medium including a halide and a rare gas; and metal storing means storing at least one selected from the group consisting of potassium (K), rubidium (Rb) and cesium (Cs), the metal storing means being heated during lighting and gradually discharging the at least one metal in the hermetic vessel, wherein an emission power ratio of visible light with wavelengths of 380 to 780 nm to near-infrared light with wavelengths of 750 to 1100 nm is 0.5:1 to 4.0:1 during stable lighting, and wherein the halide of the discharge medium contains a first halide including a halide of at least one selected from the group consisting of sodium (Na), scandium (Sc) and a rare earth metal, the halide also containing a second halide including a halide of at least one selected from the group consisting potassium (K), rubidium (Rb) and cesium (Cs), the halide further containing a third halide having a relative high vapor pressure and being a halide of at least one kind of metal that emits a visible light less than that emitted by the metal of the first halide, the discharge medium containing substantially no mercury.

14. A metal halide lamp comprising: a refractory, light-transmitting hermetic vessel;

a pair of electrodes sealed in the hermetic vessel;

a discharge medium including a halide and a rare gas; and metal storing means storing at least one selected from the group consisting of potassium (K), rubidium (Rb) and cesium (Cs), the metal storing means being heated during lighting and gradually discharging at least one metal in the hermetic vessel, wherein an emission power ratio of visible light with wavelengths of 380 to 780 nm to near-infrared light with wavelengths of 780 to 1200 nm is 2.0:1 to 3.2:1 during stable lighting, and wherein the halide of the discharge medium contains a halide of at least one selected from the group consisting of potassium (K), rubidium (Rb) and cesium (Cs).

15. The metal halide lamp according to claim 14, wherein an emission power ratio of first near-infrared light with wavelengths of 780 to 800 nm to second near-infrared light with wavelengths of 780 to 1000 nm is 0.1:1 to 0.33:1 during stable lighting.

16. The metal halide lamp according to claim 14, wherein the metal storing means is formed of at least one of the electrodes, at least one electrode containing at least one selected from the group consisting of potassium (K), rubidium (Rb) and cesium (Cs).

17. The metal halide lamp according to claim 14, wherein the halide of the discharge medium contains a halide of at least one selected from the group consisting of sodium (Na), scandium (Sc) and a rare earth metal.

18. The metal halide lamp according to claim 14, wherein the rare gas of the discharge medium mainly contains xenon (Xe).

19. The metal halide lamp according to claim 18, wherein xenon (Xe) is sealed under a pressure of not less than six atoms.

20. The metal halide lamp according to claim 14, wherein the electrodes are mainly formed of tungsten (W).

21. The metal halide lamp according to claim 14, wherein at least one selected from the group consisting of potassium (K), rubidium (Rb) and cesium (Cs) contained in the metal storing means has a concentration of 10 to 200 ppm.

22. The metal halide lamp according to claim 14, wherein the metal halide lamp has a rated lamp power falling within a range of 35±3 W.

23. The metal halide lamp according to claim 14, wherein the metal halide lamp is used for both a vehicle headlight and an infrared night imaging vision apparatus.

24. The metal halide lamp according to claim 14, wherein the metal halide lamp mainly uses near-infrared light with wavelengths of not less than 750 nm when the metal halide lamp is used for an infrared night imaging vision apparatus.

25. A metal halide lamp comprising:

a refractory, light-transmitting hermetic vessel;

a pair of electrodes sealed in the hermetic vessel;

a discharge medium including a halide and a rare gas; and metal storing means storing at least one selected from the group consisting of potassium (K), rubidium (Rb) and cesium (Cs), the metal storing means being heated during lighting and gradually discharging at least one metal in the hermetic vessel, wherein an emission power ratio of visible light with wavelengths of 380 to 780 nm to nearinfrared light with wavelengths of 780 to 1200 nm is 2.0:1 to 3.2:1 during stable lighting, and wherein the halide of the discharge medium contains a first halide including a halide of at least one selected from the group consisting of sodium (Na), scandium (Sc) and a rare earth metal, the halide also containing a second halide including a halide of at least one selected from the group consisting potassium (K), rubidium (Rb) and cesium (Cs), the halide further containing a third halide having a relatively high vapor pressure and being a halide of at least one kind of metal that emits a visible light less than that emitted by the metal of the first halide, the discharge medium containing substantially no mercury.

* * * * *